US005667318A

United States Patent [19]

Tanno et al.

[11] Patent Number: 5,667,318

[45] Date of Patent: Sep. 16, 1997

[54] CASETTE REEL HOLDING MECHANISM AND THE RECORDING APPARATUS USING THE AFORESAID CASSETTE

[75] Inventors: Koichi Tanno; Toshiro Sugiyama, both of Kawasaki, Japan

[73] Assignee: Canon Kabushiki Kaisha, Tokyo, Japan

[21] Appl. No.: 429,028

[22] Filed: Apr. 26, 1995

Related U.S. Application Data

[63] Continuation of Ser. No. 173,463, Dec. 27, 1993, abandoned, which is a continuation of Ser. No. 758,684, Sep. 12, 1991, abandoned.

[30] Foreign Application Priority Data

| | | | |
|---|---|---|---|
| Sep. 13, 1990 | [JP] | Japan | 2-241255 |
| Nov. 26, 1990 | [JP] | Japan | 2-317747 |
| Nov. 26, 1990 | [JP] | Japan | 2-317748 |
| Dec. 27, 1990 | [JP] | Japan | 2-415314 |

[51] Int. Cl.[6] ..... B41J 32/00

[52] U.S. Cl. ..... 400/208; 400/234; 400/246; 242/338.1

[58] Field of Search ..... 400/208, 234, 400/242, 246; 242/338, 338.1, 338.2, 343, 343.1, 343.2

[56] References Cited

U.S. PATENT DOCUMENTS

| | | | |
|---|---|---|---|
| 4,210,296 | 7/1980 | Frechette | 242/338.1 |
| 4,687,358 | 8/1987 | Saitou | 400/234 |
| 4,883,234 | 11/1989 | Yamakawa et al. | 242/67.3 R |
| 4,924,242 | 5/1990 | Fukawa | 400/120 |
| 4,978,240 | 12/1990 | Katsuno | 400/234 |
| 5,138,335 | 8/1992 | Sugimoto et al. | 400/242 |
| 5,143,461 | 9/1992 | Inoue et al. | 400/234 |

FOREIGN PATENT DOCUMENTS

| | | | |
|---|---|---|---|
| 10 99 755 | 2/1961 | Germany | 242/338.1 |
| 8701168 | 3/1987 | Germany . | |
| 57-168891 | 10/1982 | Japan | 400/234 |
| 57-180890 | 11/1982 | Japan | 400/234 |
| 32687 | 2/1985 | Japan | 400/246 |
| 67185 | 4/1985 | Japan | 400/242 |
| 114876 | 6/1986 | Japan | 400/242 |
| 61-152475 | 7/1986 | Japan | 400/234 |
| 63-276576 | 11/1988 | Japan . | |
| 95875 | 4/1990 | Japan | 400/246 |

*Primary Examiner*—David A. Wiecking

*Attorney, Agent, or Firm*—Fitzpatrick, Cella, Harper & Scinto

[57] ABSTRACT

A cassette which can be molted in a recording apparatus includes a first winding member for winding one side of a strip member, a second winding member for winding the other side of the strip member, and a frame for rotatively housing the first and second winding members. A first regulating member regulates the rotation of the first winding member when the cassette is removed from the recording apparatus, and a second regulating member regulates the rotation of the second winding member when the cassette is removed from the recording apparatus. With the simple structure enabling the cassette to be easily assembled, it is possible to prevent the idle run of the winding members as well as the slacking of the strip member.

4 Claims, 19 Drawing Sheets

CASETTE REEL HOLDING MECHANISM AND THE RECORDING APPARATUS USING THE AFORESAID CASSETTE

This application is a continuation of application Ser. No. 07/173,463, filed Dec. 27, 1993, which is a continuation of application Ser. No. 07/758,684, filed Sep. 12, 1991, now both abandoned.

BACKGROUND OF THE INVENTION

1. Field of the Invention

The present invention relates to a cassette for storing a strip member and a recording apparatus using the aforesaid cassette. More particularly, the present invention relates to a cassette having a control member for controlling the rotation of a winding member to wind a strip member, and a recording apparatus using the aforesaid cassette.

2. Related Background Art

The strip ink sheet used for a thermal transfer printer is extremely thin, so that the strip ink sheet has been cassetted in many cases for its easy handling in recent years, and in general, a brake mechanism is provided in the cassette in order to prevent the supply reel and rewinding reel, which are stored therein, from running idle.

In the conventional cassette, the supply reel 52 with the ink sheet 51, which is a strip member, wound around the reel and the rewinding reel 53 are rotatively stored in a case 50 as shown in FIG. 1, and on one side end in the axial direction of each of the reels 52 and 53, a V shaped groove 54 is formed in the radial direction each at an angle of 90° as shown in FIG. 2A. In the inner face of the case 50 facing this end, a V shaped projection 55 as shown in FIG. 2B is formed. Then, the supply reel 52 and rewinding reel 53 are pressed toward the V shaped projections 55 of the case 50 by the compression of flat springs 56 and others to allow the aforesaid V shaped grooves 54 and V shaped projections 55 to be fitted for stoppage.

In the aforesaid cassette, the rotation of the reels 52 and 53 is regulated by the V shaped projections 55 of the case 50 which are fitted into the V shaped grooves 54 of the reels 52 and 53 so as not to allow them to run idle. Then, the structure is arranged so that when the aforesaid cassette is installed into the recording apparatus, the reel driving shafts which are not shown in FIG. 1 are coupled to the supply reel 52 and rewinding reel 53 and at the same time, the reels 52 and 53 are pressed in the direction indicated by arrow x in FIG. 1 to release the fitting of the aforesaid V shaped grooves 54 and V shaped projections 55.

However, in the structure wherein the rotation of the reels 52 and 53 is regulated by the fitting of the aforesaid V shaped grooves 54 and V shaped projections 55, the V shaped grooves 54 on the reels 52 and 53 are provided each at an angle of 90° in the radial direction. Therefore, when the cassette is removed from the recording apparatus, each of the reels 52 and 53 is rotated maximum 90° if the aforesaid V shaped grooves 54 and V shaped projection 55 are not fitted at that time. As a result, the ink sheet 51 is caused to slack in an amount equivalent to 180° as a whole. This slacking can be reduced by increasing the numbers of the V shaped grooves 54, but its complete elimination is impossible.

Also, in the case where an irregularity of rewinding occurs or expansion of the ink sheet 51 occurs in use, the slacking of the ink sheet 51 is still generated at the time of its removal from the recording apparatus in a state that the V shaped grooves 54 and V shaped projections 55 are fitted exactly even if the slacking of the ink sheet 51 between the reels 52 and 53 is completely removed before the aforesaid cassette is installed into the recording apparatus. Then, there is a possibility that the ink sheet 51 is wrinkled by a shock when the fitting of the V shaped grooves 54 and V shaped projections 55 is once released to rotate the reels 52 and 53 to remove the aforesaid slacking and the V shaped grooves 54 and V shaped projections 55 are again fitted subsequent thereto.

As for another structure of the conventional cassette, there is a structure such as shown in FIG. 3 wherein the ink sheet 150 is wound around the supply reel 151 and rewinding reel 152, and the reels 151 and 152 are supported by the reel receiving portion 153*a* in the lower case 153 and the reel receiving portion 154*a* in the upper case 154. At the same time, springs 155 are sandwiched to give tension to the reels 151 and 152 in the axial direction, and the upper and lower cases 153 and 154 are welded or fixed by machine screws or the like.

However, the aforesaid cassette needs many numbers of parts as compared with its simple structure, and it takes more time in assembling the cassette because a process is needed to couple the upper and lower cases 153 and 154, leading to an increase in its manufacturing cost.

Also, as to the brake mechanism for the cassette storing a cassette tape and the like, there is disclosed a brake mechanism in Japanese Utility Model Laid-Open Application No. 57-168891, Japanese Utility Model Laid-Open Application No. 57-180890, and others, wherein a pair of reels each having teeth on the periphery of its flange are incorporated in the case, and the braking nails are caused to fit into the aforesaid teeth respectively. However, there are problems that not only the numbers of the parts are great, but the structure is also complicated.

SUMMARY OF THE INVENTION

An object of the present invention is to solve the above-mentioned problems existing in the conventional art and to provide a cassette that is easy to be built with a reduced numbers of parts, and a recording apparatus using the aforesaid cassette.

Another object of the present invention is to solve the above-mentioned problems existing in the conventional art and to provide a simply structured cassette capable of controlling the rotation of its winding members without generating the slacking of the strip member, and a recording apparatus using the aforesaid cassette.

Still another object of the present invention is to provide a cassette capable of preventing the slacking of the strip member by regulating the rotation of the winding members with the friction generated when the taper portions formed on the winding members are pressed against the case, and a recording apparatus capable of releasing the aforesaid pressure of the taper portions against the case when the aforesaid cassette is installed therein.

A further object of the present invention is to provide a cassette capable of preventing the slacking of the strip member by regulating the rotation of the winding members with the friction generated by the winding members being pressed against the case, and a recording apparatus capable of releasing the aforesaid pressure of the winding members against the case when the aforesaid cassette is installed therein.

Still a further object of the present invention is to provide a cassette capable of preventing the idle rotation of the winding members reliably by constructing the first winding member and second winding member to be partially in contact with the case under pressure so as to prevent the slacking of the strip member reliably, and a recording apparatus using the aforesaid cassette.

Still another object of the present invention is to provide a cassette mountable in a recording apparatus, which includes a first winding member for winding one side of the strip member, a second winding member for winding the other side of the aforesaid strip member, and a frame to house the aforesaid first winding member and second winding member rotatively, a first regulating member for regulating the rotation of the first winding member when the aforesaid cassette is removed from the recording apparatus, and a second regulating member for regulating the rotation of the second winding member when the aforesaid cassette is removed from the recording apparatus.

Still another object of the present invention is to provide a cassette mountable in a recording apparatus, which includes a first winding member for winding one side of the strip member, a second winding member for winding the other side of the aforesaid strip member, a frame to house the aforesaid first winding member and second winding member rotatively, a first pressure member for pressing the aforesaid first winding member to the aforesaid frame in the direction perpendicular to the shaft of the first winding member, which regulates the rotation of the first winding member when the aforesaid cassette is removed from the recording apparatus, and a second pressure member for pressing the aforesaid second winding member to the aforesaid frame in the direction perpendicular to the shaft of the second winding member, which regulates the rotation of the second winding member when the aforesaid cassette is removed from the recording apparatus.

Still another object of the present invention is to provide a cassette mountable in a recording apparatus, which includes a first winding member for winding one side of the strip member, a second winding member for winding the other side of the aforesaid strip member, a frame to house the aforesaid first winding member and second winding member rotatively, a first taper portion provided at the end of the shaft of the first winding member, which regulates the rotation of the first winding member when the aforesaid cassette is removed from the recording apparatus, and a second taper portion provided at the end of the shaft of the second winding member, which regulates the rotation of the second winding member when the aforesaid cassette is removed from the recording apparatus.

Still another object of the present invention is to provide a cassette mountable in a recording apparatus, which includes a first winding member for winding one side of the strip member, a second winding member for winding the other side of the aforesaid strip member, and a frame to house the aforesaid first winding member and second winding member rotatively, which is partially in contact with the peripheries of the aforesaid first winding member and second winding member under pressure to regulate the rotation of the aforesaid first and second winding members when the aforesaid cassette is removed from the recording apparatus.

Still another object of the present invention is to provide a cassette mountable in a recording apparatus, which includes a first winding member for winding one side of the strip member, a second winding member for winding the other side of the aforesaid strip member, and a frame to house the aforesaid first winding member and second winding member rotatively, supporting portions for supporting respectively the aforesaid first winding member and second winding member provided on the aforesaid frame, a first biasing portion for thrusting the aforesaid first winding member in the longitudinal direction of the shaft of the first winding member, which regulate the rotation of the first winding member when the aforesaid cassette is removed from the recording apparatus, and a second biasing portion for biasing the aforesaid second winding member in the longitudinal direction of the shaft of the second winding member, which regulates the rotation of the second winding member when the aforesaid cassette is removed from the recording apparatus.

Still another object of the present invention is to provide a recording apparatus, which includes a recording unit for performing the recording on a recording medium by applying energy to the strip member, and an installation unit for installing a cassette having a first winding member for winding one side of the strip member, a second winding member for winding the other side of the aforesaid strip member, and a frame to house the aforesaid first winding member and second winding member rotatively, a first regulating member for regulating the rotation of the first winding member when the aforesaid cassette is removed from the recording apparatus, and a second regulating member for regulating the rotation of the second winding member when the aforesaid cassette is removed from the recording apparatus.

Still another object of the present invention is to provide a recording apparatus, which includes a recording unit for performing the recording on a recording medium by applying energy to the strip member, and an installation unit for installing a cassette having a first winding member for winding one side of the strip member, a second winding member for winding the other side of the aforesaid strip member, and a frame to house the aforesaid first winding member and second winding member rotatively, a first pressure member for pressing the first winding member against the aforesaid frame in the direction perpendicular to the shaft of the first winding member, which regulates the rotation of the first winding member when the aforesaid cassette is removed from the recording apparatus, and a second pressure member for pressing the second winding member against the aforesaid frame in the direction perpendicular to the shaft of the second winding member, which regulates the rotation of the second winding member when the aforesaid cassette is removed from the recording apparatus.

Still another object of the present invention is to provide a recording apparatus, which includes a recording unit for performing the recording on a recording medium by applying energy to the strip member, and an installation unit for installing a cassette having a first winding member for winding one side of the strip member, a second winding member for winding the other side of the aforesaid strip member, a frame to house the aforesaid first winding member and second winding member rotatively, a first taper portion provided at the end of the shaft of the first winding member, which regulates the rotation of the first winding member when the aforesaid cassette is removed from the recording apparatus, and a second taper portion provided at the end of the shaft of the second winding member, which regulates the rotation of the second winding member when the aforesaid cassette is removed from the recording apparatus.

Still another object of the present invention is to provide a recording apparatus, which includes a recording unit for performing the recording on a recording medium by applying energy to the strip member, and an installation unit for installing a cassette having a first winding member for winding one side of the strip member, a second winding member for winding the other side of the aforesaid strip member, and a frame to house the aforesaid first winding member and second winding member rotatively, which is partially in contact with the peripheries of the aforesaid first winding member and second winding member under pressure to regulate the rotation of the aforesaid first and second winding members when the aforesaid cassette is removed from the recording apparatus.

Still another object of the present invention is to provide a recording apparatus, which includes a recording unit for performing the recording on a recording medium by applying energy to the strip member, and an installation unit for installing a cassette having a first winding member for winding one side of the strip member, a second winding member for winding the other side of the aforesaid strip member, and a frame to house the aforesaid first winding member and second winding member rotatively, supporting portions for supporting respectively the aforesaid first winding member and second winding member provided on the aforesaid frame, a first biasing portion for biasing the aforesaid first winding member in the longitudinal direction of the shaft of the first winding member, which regulates the rotation of the first winding member when the aforesaid cassette is removed from the recording apparatus, and a second biasing portion for biasing the aforesaid second winding member in the longitudinal direction of the shaft of the second winding member, which regulates the rotation of the second winding member when the aforesaid cassette is removed from the recording apparatus.

DETAILED DESCRIPTION OF THE PREFERRED EMBODIMENTS

Hereinafter, the embodiments suited for the application of the present invention will be described in conjunction with the accompanying drawings.

Figure 1:
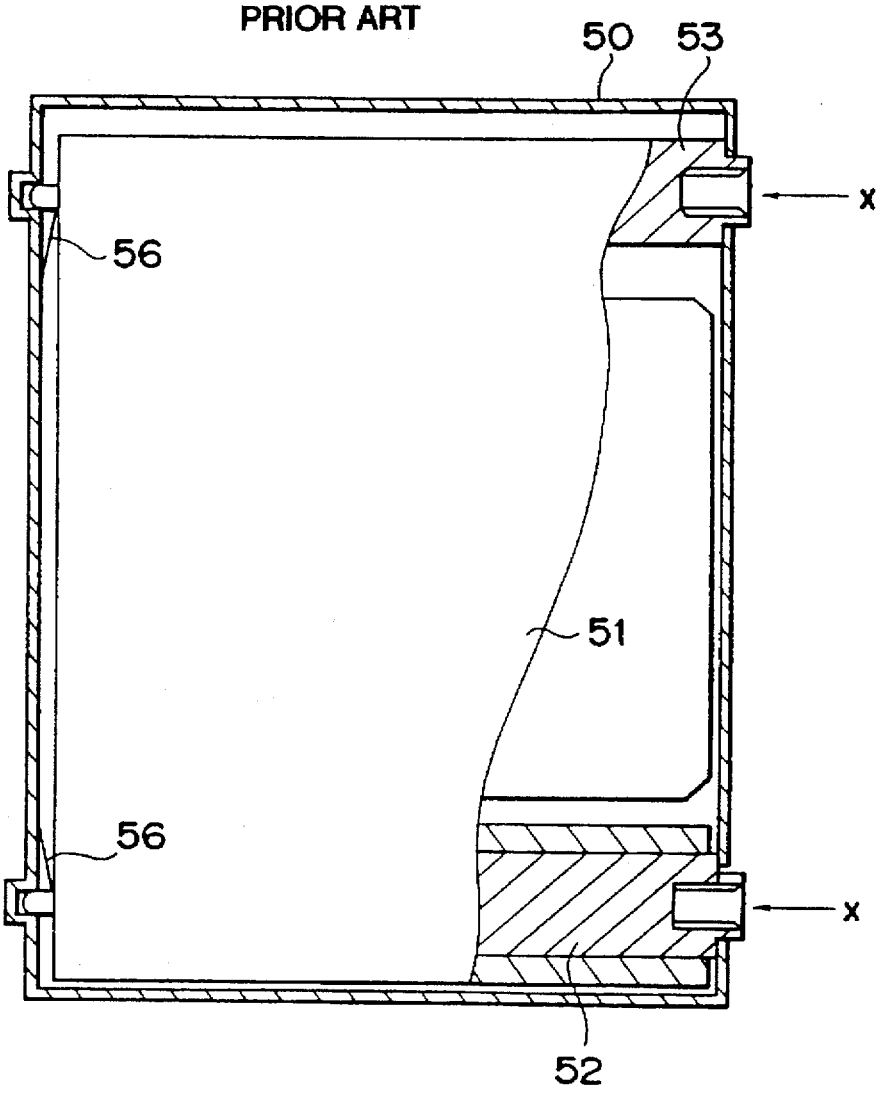
FIG. 1 PRIOR ART
FIG. 1 is a view schematically showing the structure of a conventional cassette.
Figure 2A:
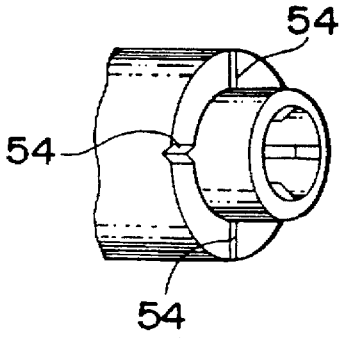
FIG. 2A PRIOR ART
FIG. 2A and FIG. 2B are views showing the structure of a conventional cassette.
Figure 2B:
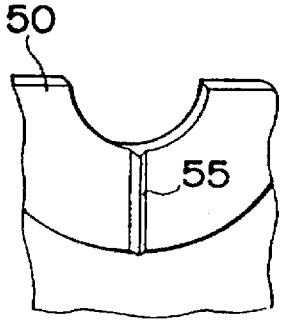
FIG. 2B PRIOR ART
Figure 3:
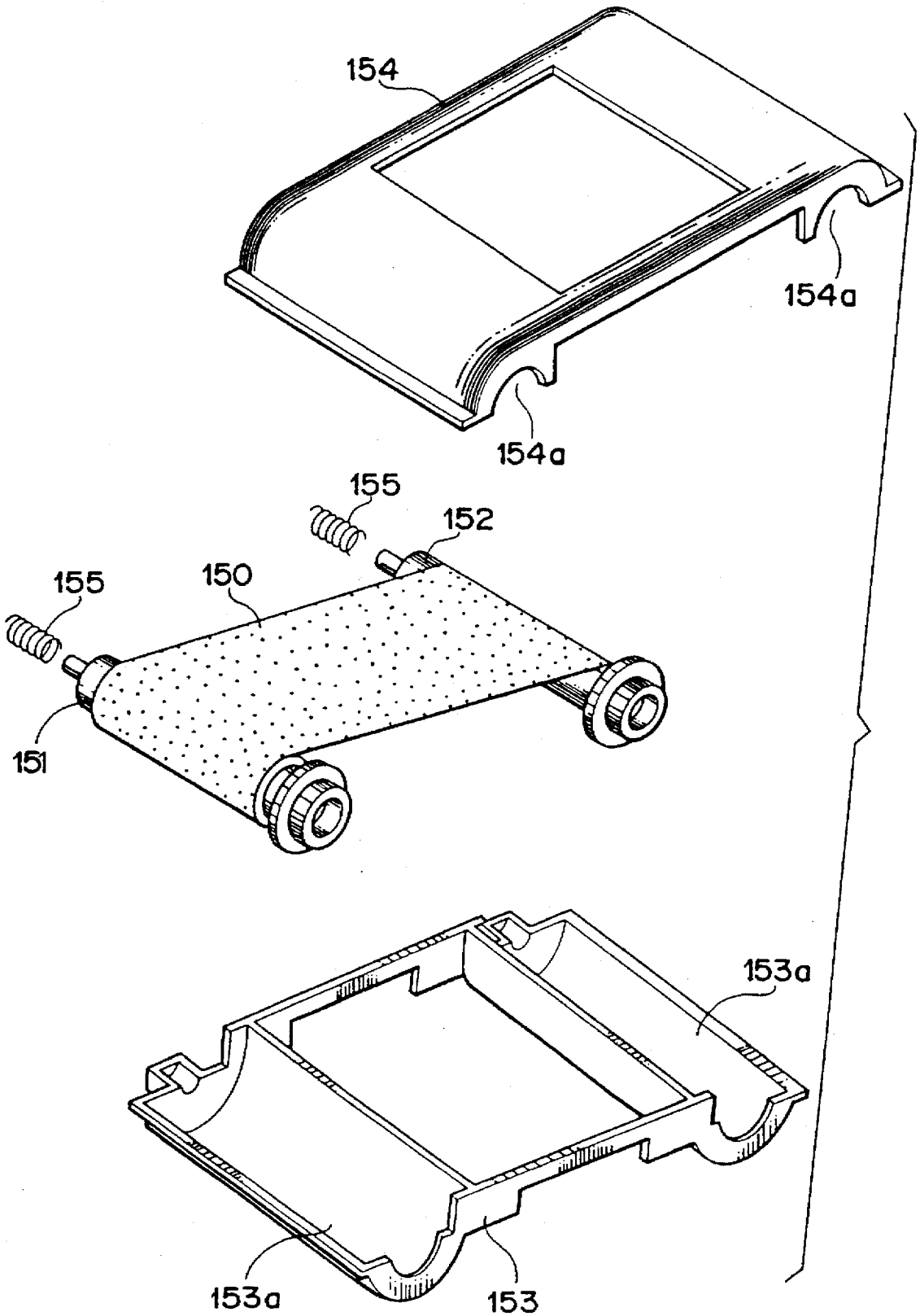
FIG. 3 PRIOR ART
FIG. 3 is a view schematically showing the structure of another conventional cassette.
Figure 4:
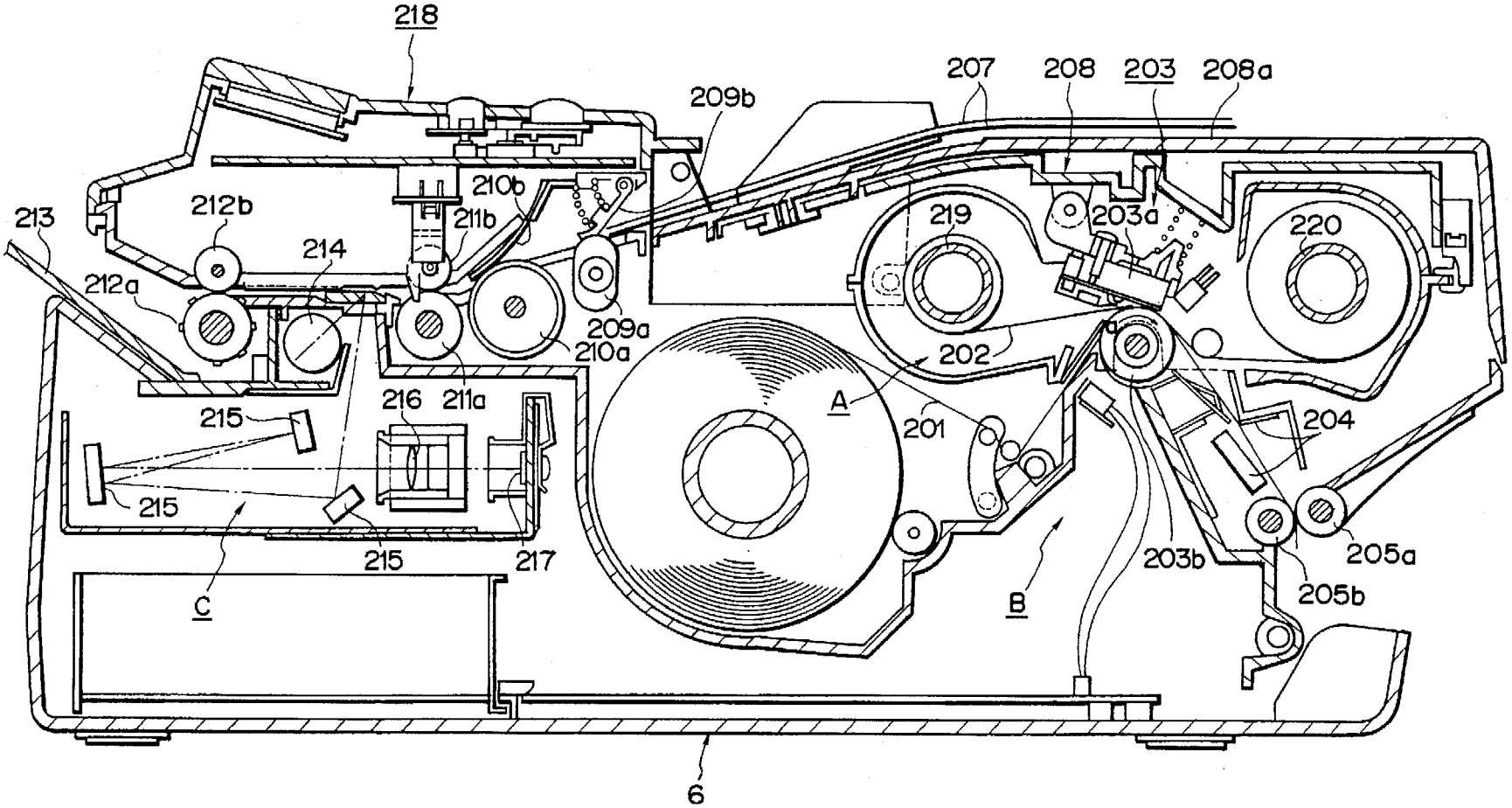
FIG. 4 is a view illustrating the structure of a facsimile apparatus as a recording apparatus using an embodiment of the cassette according to the present invention.
Figure 5:
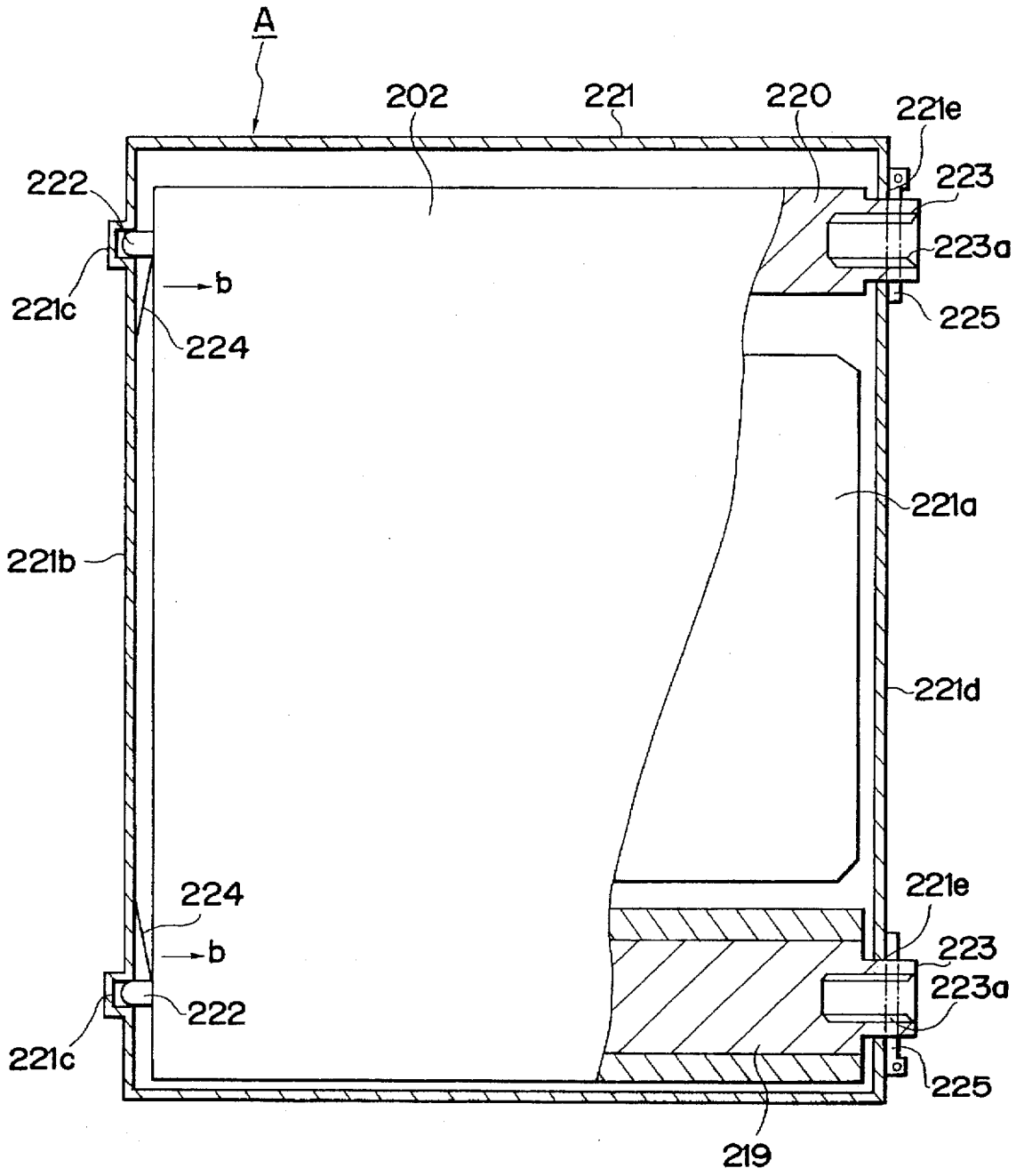
FIG. 5 is a view schematically showing the structure of a first embodiment of the cassette according to the present invention.

FIG. 5 is a cross-sectional illustration of a cassette A (refer to FIG. 4) in which an ink sheet is stored, and FIG. 4 is a cross-sectional illustration of the recording apparatus B which performs the recording with the aforesaid cassette mounted therein. In this respect, the recording apparatus B is structured as the recording system for a facsimile apparatus.

At first, in conjunction with FIG. 4, the entire structure of the facsimile apparatus will be described. This facsimile apparatus comprises the recording system B for performing the recording with a cassette A mounted therein, and the reading system C which reads the image written on an original.

The recording system B records the image on a recording sheet 201 which is a recording medium in accordance with the image signal transmitted from another machine or the image signal transmitted from the reading system C which will be described later. In other words, the overrupped recording sheet 201 and ink sheet 202 are pressed by a recording head 203*a* constituting the recording means 203 against the platen roller 203*b* which is a rotational body, and the recording sheet 201 and ink sheet 202 are conveyed in the direction indicated by arrow a by rotating the platen roller 203*b* in the direction indicated by arrow a in FIG. 4. Then, the structure is arranged so that in synchronism with the conveyance of the aforesaid recording sheet 201 and ink sheet 202, the recording head 203*a* is caused to generate heat in response to the image signal to fuse the coated ink on the ink sheet 202 (sublimation included and hereinafter, the same), and transfers the fused ink to the recording sheet 201 for the formation of the image.

The recording sheet 201 with the specific image formed by the aforesaid recording means 203 is further conveyed in the direction indicated by arrow a, and is exhausted to the outside of the recording apparatus by the arrangement of a pair of exhausting rollers 205*a* and 205*b* subsequent to having been cut by a cutter 204.

Also, the ink sheet 202 is stored in the cassette A structured as described later in the present embodiment, and the structure is arranged so that the cassette A is detachably mounted or installed in the main body 206 of the recording apparatus.

On the other hand, the reading system C is such that light is irradiated onto the original 207 and its reflected rays of light are converted into the electrical signals which are transmitted to another machine or to the recording system B of its own.

In other words, on the original stacker 208*a* formed on the upper surface of a recording cover 208, plural sheets of an original 207 are stacked, and these originals 207 are conveyed preliminarily by a preliminary feed roller 209*a* and a pressure blade 209*b* and are separated by a separation roller 210*a* and a pressure blade 210*b* to contact therewith one by one for feeding simultaneously. Then, the structure is arranged so that the separated original 207 is further conveyed by a pair of feed rollers 211*a* and 211*b* and is exhausted onto a exhaust tray 213 by a pair of exhaust rollers 212*a* and 212*b*. While the original 207 is being conveyed light is irradiated from the light source 214 onto the surface of the original 207. Then, the structure is arranged to allow the reflected rays of light therefrom to reach a photoelectric converting element 217 such as CCD through a mirror 215 and a lens 216 to transmit the image signals to the recording system of its own in the case of copying mode or to the recording system of another machine in the case of transmitting mode.

The aforesaid mode switching operation, copying operation, transmission operation, and others are performed on an operation panel 218. The operation panel 218 is provided above the original conveying mechanism in the reading system C, and is structured rotatively with respect to the main body 206 of the recording apparatus.

Subsequently, the specific description will be made of the structure of the cassette A to be mounted in the aforesaid recording system B.

In FIG. 5, one side of a strip type ink sheet 202 is wound around a supply reel 219 which is a first winding member, and the other side thereof is wound around a winding reel 220 which is a second winding member. The aforesaid supply reel 219 and winding reel 220 are housed in a case 221.

Figure 6:
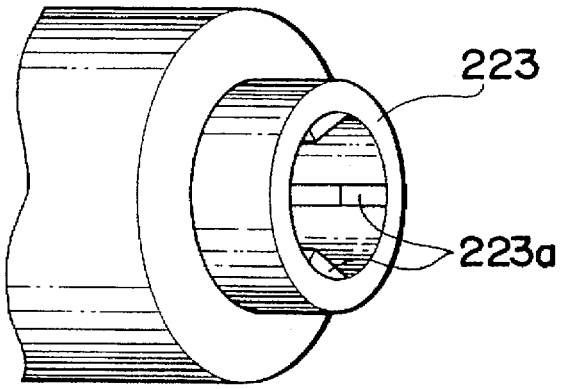
FIG. 6 is a view illustrating a hollow cylindrical portion of a small diameter.

At one end of each of the aforesaid reels 219 and 220, there is formed a pivot 222 in the longitudinal direction, and at the other end thereof, a small-diameter hollow cylindrical portion 223, respectively. In the inner periphery of this small-diameter hollow cylindrical portion 223, coupling nails 223*a* are formed as shown in FIG. 6. These coupling nails 223*a* are configured to couple with the reel base which will be described later.

The case 221 to house the aforesaid reels 219 and 220 is provided with a window 221*a* for recording in the center thereof as shown in FIG. 5 to allow the ink sheet 202 to be exposed, and on the side wall 221*b* at one side, there are formed concavities 221*c* which support the pivots 222 of the reels 219 and 220 rotatively. These concavities 221*c* are formed with the depth to allow the reels 219 and 220 to be slightly slidable in the longitudinal direction.

Figure 7:
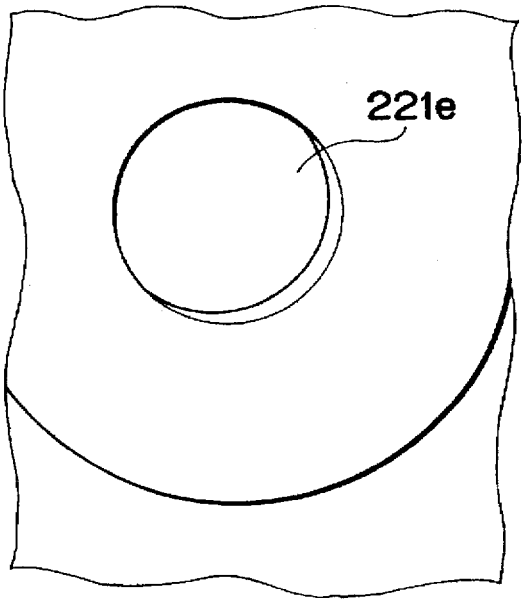
FIG. 7 is a view illustrating the fitting hole of a case.

Also, on the side wall 221 of the other side of the case 221, holes 221*e* are formed as shown in FIG. 7 to allow the small-diameter hollow cylindrical portions 223 of the reels 219 and 220 to be rotatively inserted. Then, on the inner face of the aforesaid side wall 221*b*, flat springs 224 are mounted, and the reels 219 and 220 are biased in the direction indicated by arrow b in FIG. 5 by these springs 224. Thus, the aforesaid cylindrical portions 223 are projected from the holes 219*e* to the outside. In this respect, the reels 219 and 220 slide in the direction indicated by arrow b in FIG. 5 by the aforesaid biasing force but the structure is arranged so that the pivots 222 are not allowed to fall off from the concavities 221*c*.

On the side wall 221*d* of the aforesaid case 221, flat springs 225 which constitute the biasing means for thrusting the supply reel 219 and winding reel 220 in the radial direction are mounted. These flat springs 225 bias the reels 219 and 220 in the radial direction (the direction perpendicular to the shaft of the reel), and by this force, the cylindrical portions 223 of the reels 219 and 220 are biased against the circumferential plane of the holes 221*e* in the case 221, and the rotation of the reels 219 and 220 are regulated by this compression. Therefore, the reels 219 and 220 are not allowed to run idle in a state where the cassette A is removed from the recording apparatus B, and no slacking of the ink sheet 202 occurs.

Subsequently, the description will be made of the case where the aforesaid cassette A is mounted in the recording apparatus B.

Figure 8:
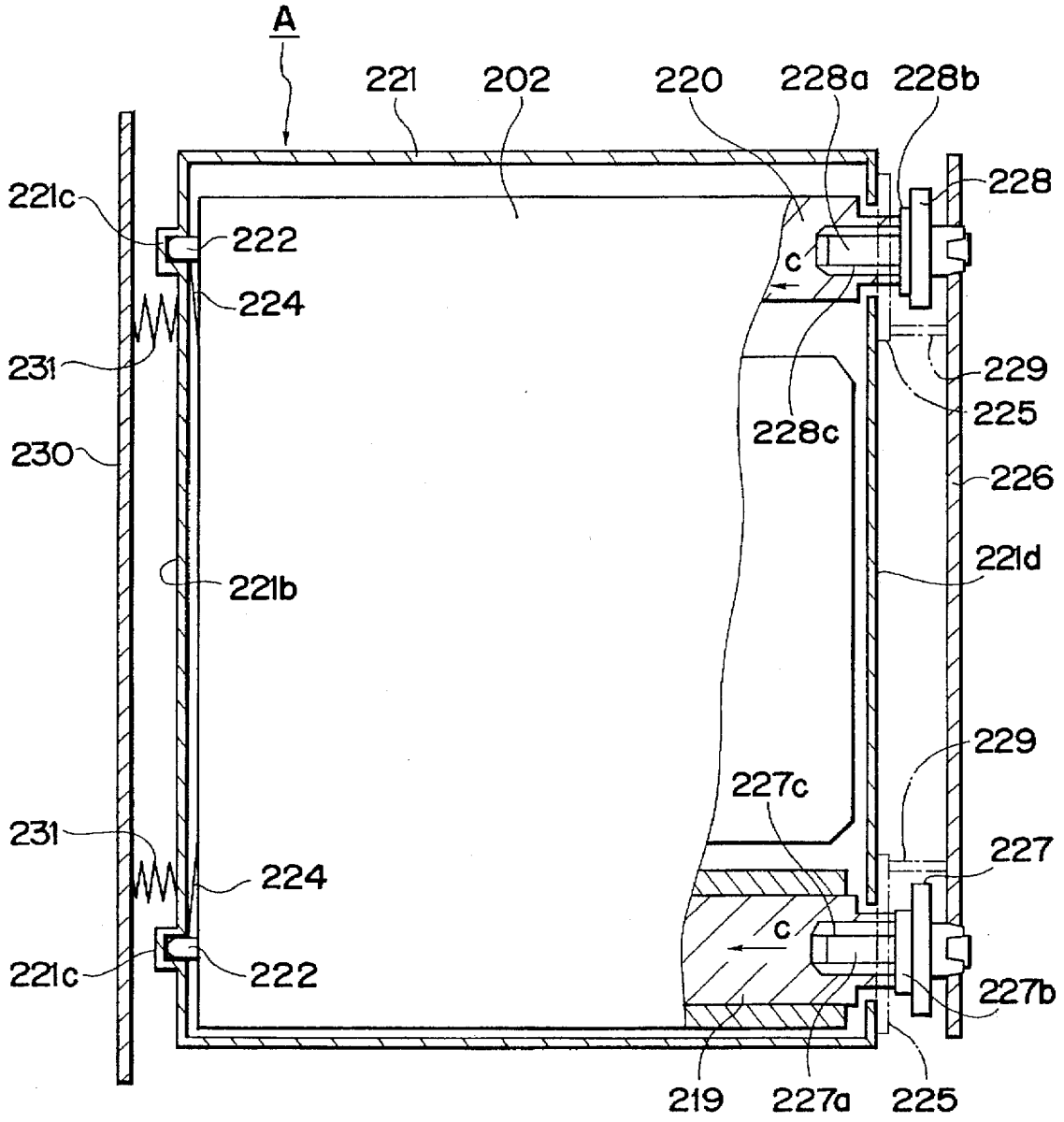
FIG. 8 is a view schematically showing the structure of the cassette shown in FIG. 5 in a state where the cassette is mounted in a cassette mounting portion.

For the cassette installation unit of the recording apparatus B, reel bases 227 and 228 are rotatively mounted on the chassis 226 as shown in FIG. 8. The aforesaid reel bases 227 and 228 comprise the shaft portions 227*a* and 228*b* which are inserted into the small-diameter hollow cylinder portions 223 of the reels 219 and 220, and contacting portions 227*b* and 228*b* with which the leading ends of the aforesaid cylinder portions are in contact, and on the aforesaid shaft portions 227*a* and 227*b*, nails 227*c* and 228*c* are formed in the radial direction to couple with the nails 223*b* of the cylinder portions 223.

Figure 9:
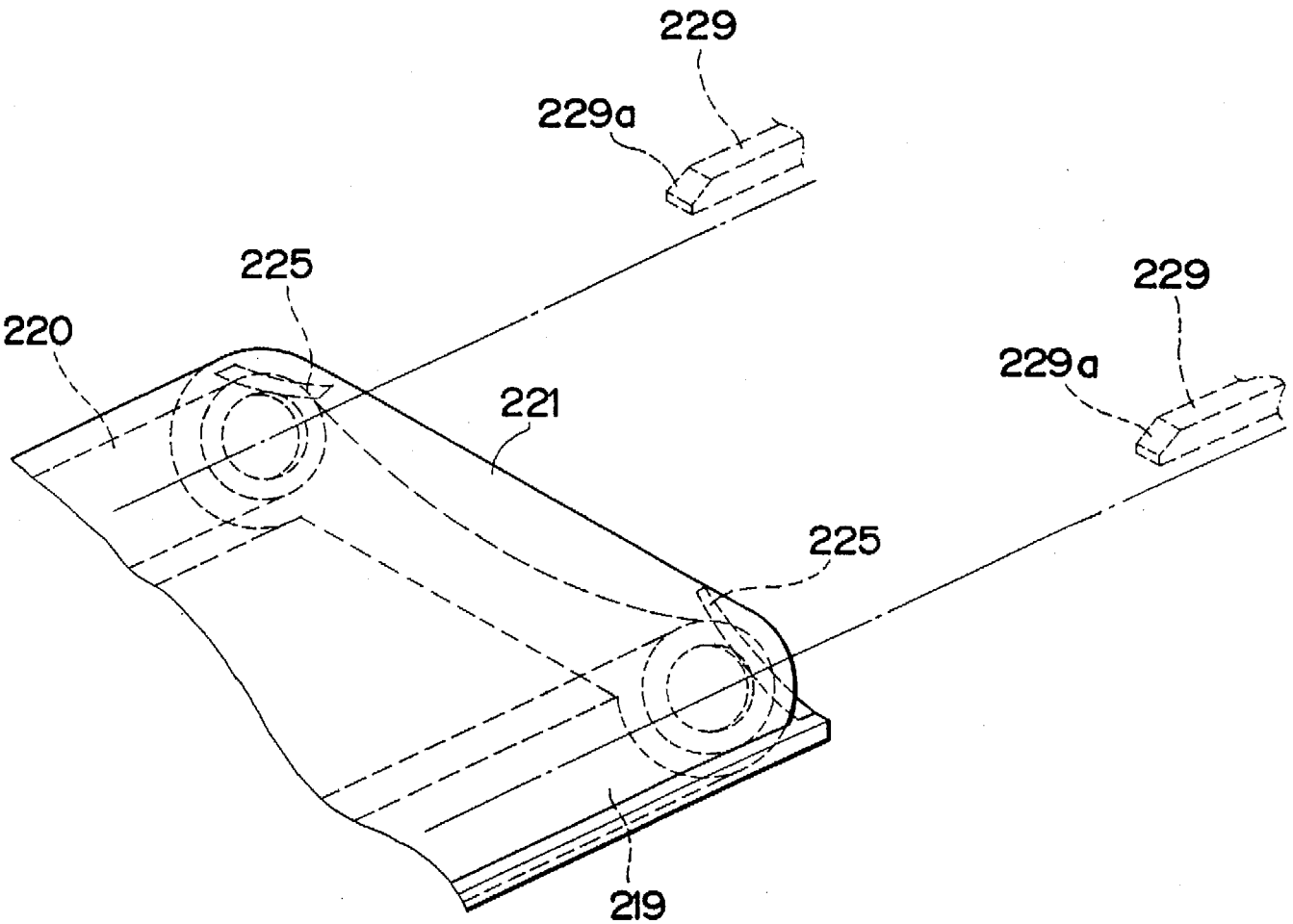
FIG. 9 is a view illustrating the structure of the flat springs which give tension to the reels in the direction perpendicular to the reel shafts when such tension is released.

Also, in the aforesaid chassis 226, releasing nails 229 such as shown in FIG. 8 and FIG. 9 are mounted, and when the cassette A is mounted in the recording apparatus B, the leading ends of the flat springs 225 are in contact with the slanting portions 229*a* of the releasing nails 229 shown in FIG. 9, and are pushed upward along the slanting portions 229*a*. Thus, the flat springs 225 are caused to leave the reels 219 and 220 to release its bias in the radial direction of the reels 219 and 220.

Further, when the cassette A is mounted, one of the reel bases 227 is coupled to the supply reel 219 while the other reel base 228, to the winding reel 220. Then, the structure is arranged to provide the rotational force for the aforesaid reel base 228 through a driving power transmission mechanism (not shown) to allow the winding reel 220 to wind the ink sheet 202 for recording. On the other hand, the reel base 227 is structured so that a predetermined load is applied thereto when rotated to given a predetermined tension to the ink sheet 202 to be drawn from the supply reel 219.

Also, on the side wall 221*b* of the cassette 221, there is provided a pressure plate 230 which can be opened or closed. On this pressure plate 230, springs 231 are provided. The biasing force of the spring members 231 is set to be stronger than that of the flat springs 224 provided for the cassette A, and the structure is arranged so that when the pressure plate 230 is closed, the springs 231 are caused to press the side wall 221*b* of the cassette A in the vicinities where the flat springs 224 are provided therefor.

Consequently, when the shaft portions 226*a* and 227*b* of the reel bases 228 and 227 are inserted into the small-diameter hollow cylinder portions 223 of the aforesaid cassette A and the pressure plate 230 is closed, the contacting portions 228*b* and 227*b* are caused to be in contact with the leading ends of the aforesaid cylinders 223 by the biasing force of the springs 231 and at the same time, compress the reels 219 and 220 in the direction indicated by arrow c in FIG. 8. Then, as the pivots 222 are structured to butt the bottom of the concavities 221*c* at that time, the position of the reels in the longitudinal direction is thus determined.

Subsequent to the cassette A having been mounted in the recording apparatus B in the manner as described above, the platen roller 203*b* is driven to convey the recording sheet 201 and ink sheet 202 while the recording head 203*a* is driven to cause the ink sheet 202 to be selectively heated thereby to perform the recording.

In the cassette A structured as above, when the cassette A is removed from the cassette installation unit, the reels 219 and 220 are biased in the radial direction by the biasing force of the flat springs 225 to be in contact with the holes 221*e* of the case 221, and the rotation of the reels 219 and 220 is regulated to prevent the slacking of the ink sheet 202.

In this respect, a cassette for an ink sheet is examplified as the cassette A in which the ink sheet 202 is accommodated, but its strip member is not necessarily limited to the aforesaid ink sheet 202. For example, it may be possible to use the cassette A for a cassette in which the magnetic tape for a video tape recorder is accommodated.

According to the present invention as set forth above, the rotation of the first winding member and second winding member is regulated by thrusting the first winding member and second winding member in the radial direction to press them against the case. Therefore, it is possible to make the structure simple to reliably prevent the winding members from running idle as well as to prevent the slacking of the strip member assuredly.

Subsequently, as a second embodiment of the cassette according to the present invention, the structure of a cassette A1 mountable in the aforesaid recording system B will be described specifically.

Figure 10:
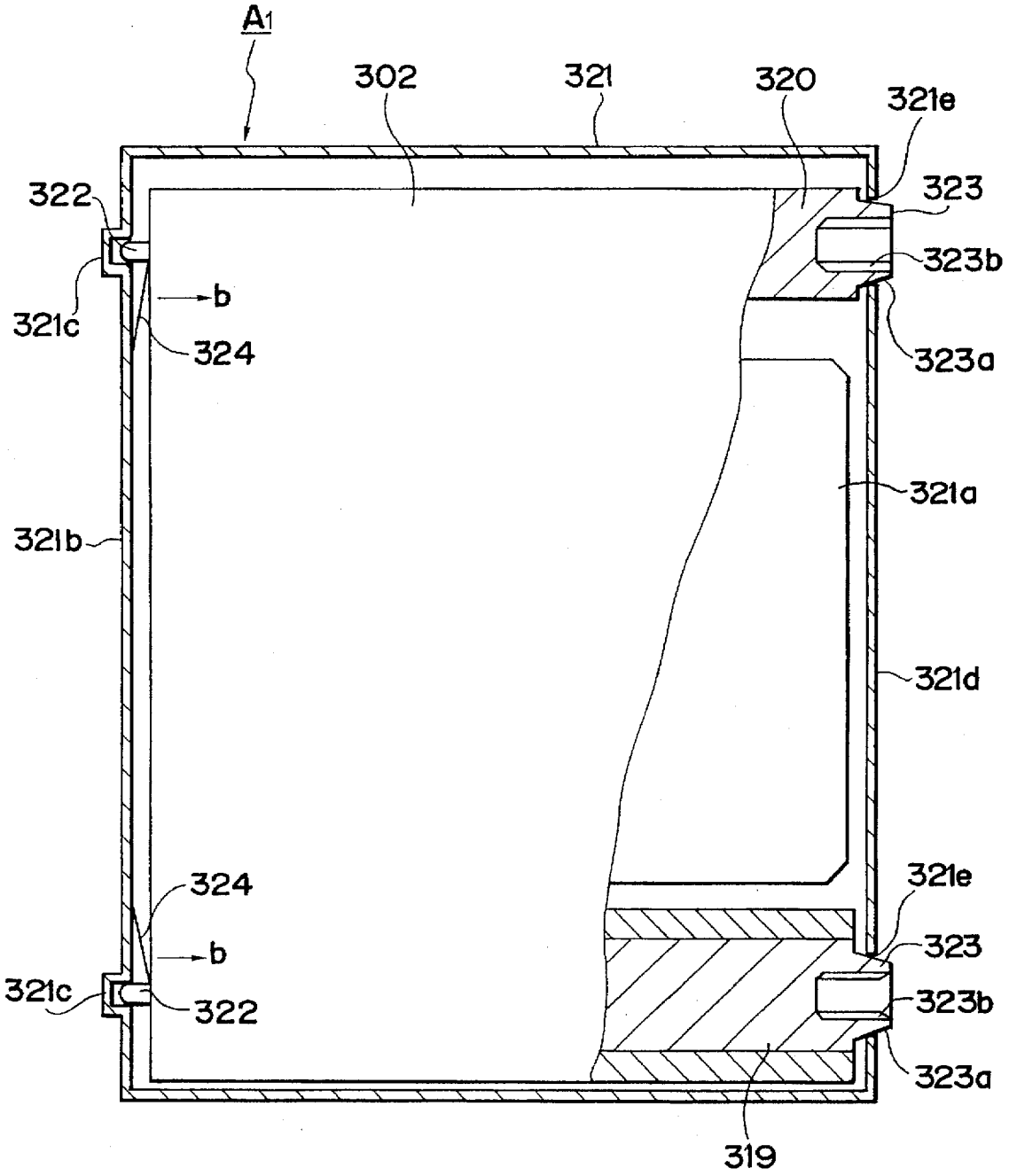
FIG. 10 is a view schematically showing a second embodiment of the cassette according to the present invention.

In FIG. 10, one side of a strip type ink sheet 302 is wound around a supply reel 319 which is a first winding member, and the other side thereof is wound around a winding reel 320 which is a second winding member. The aforesaid supply reel 319 and winding reel 320 are housed in a case 321.

Figure 11:
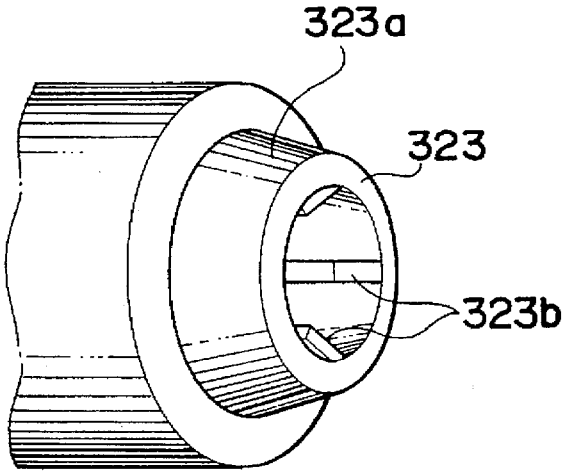
FIG. 11 is a view illustrating a hollow cylindrical portion of a small diameter.

At one end of each of the aforesaid reels 319 and 320, there is formed a pivot 322 in the longitudinal direction and at the other end thereof, a small-diameter hollow cylindrical portion 323, respectively. On the outer periphery of this small-diameter hollow cylindrical portion 323, a taper portion 323*a* is formed, which is configurated to be thinner toward its leading end as shown in FIG. 11. Also, on the inner periphery of the aforesaid cylindrical portion 323, coupling nails 323*b* are formed. These coupling nails 323*b* are structured to couple with the reel base which will be described later. The case 321 to house the aforesaid reels 319 and 320 is provided with a window 312*a* for recording in the center thereof as shown in FIG. 10 to allow the ink sheet 302 to be exposed, and on the side wall 312*b* at one side, there are formed concavities 321*c* which support the pivots 322 of the reels 319 and 320 rotatively. These concavities 321*c* are formed with the depth to allow the reels 319 and 320 to be slightly slidable in the longitudinal direction.

Figure 12:
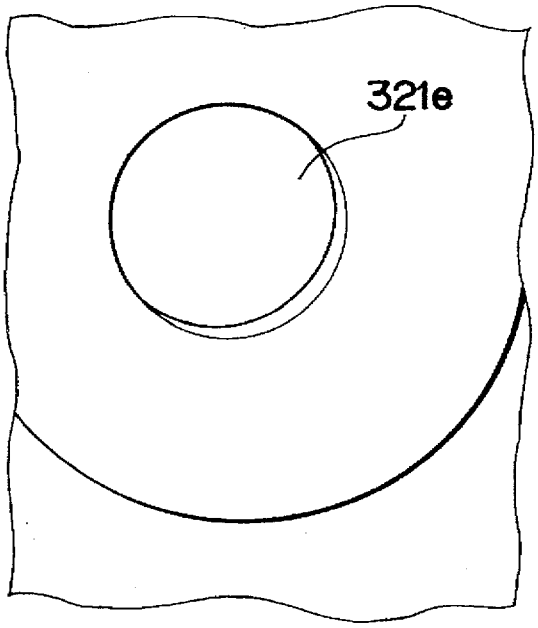
FIG. 12 is a view illustrating the fitting hole of a case.

Also, on the side wall 321*d* of the other side of the case 321, holes 321*e* are formed as shown in FIG. 12 to allow the small-diameter hollow cylindrical portions 323 of the reels 319 and 320 to be rotatively inserted. The inner diameter of these holes 321*e* is made larger than the outer diameter of the leading end of the aforesaid taper portions 323*a* but smaller than the outer diameter of the bases thereof.

Then, the inner face of the aforesaid side wall 321*b*, flat springs 324 are mounted, and the reels 319 and 320 are biased in the direction indicated by arrow b in FIG. 10 by these springs 324. Thus, the outer peripheries of the taper portions 323*a* in the radial direction are in contact with the holes 321*e* of the case 321 by this biasing force, and the rotation of the reels 319 and 320 is regulated by the friction between them. Therefore, when the cassette A1 is removed from the recording apparatus B, the reels 319 and 320 are not allowed to run idle to prevent the slacking of the ink sheet 302 accordingly.

In this respect, the reels 319 and 320 slide in the direction indicated by arrow b in FIG. 10 by the aforesaid biasing force, but the structure is arranged so that the pivots 322 are not caused to fall off from the concavities 321*c*.

Subsequently, the description will be made of the case where the aforesaid cassette A1 is mounted in the recording apparatus B.

Figure 13:
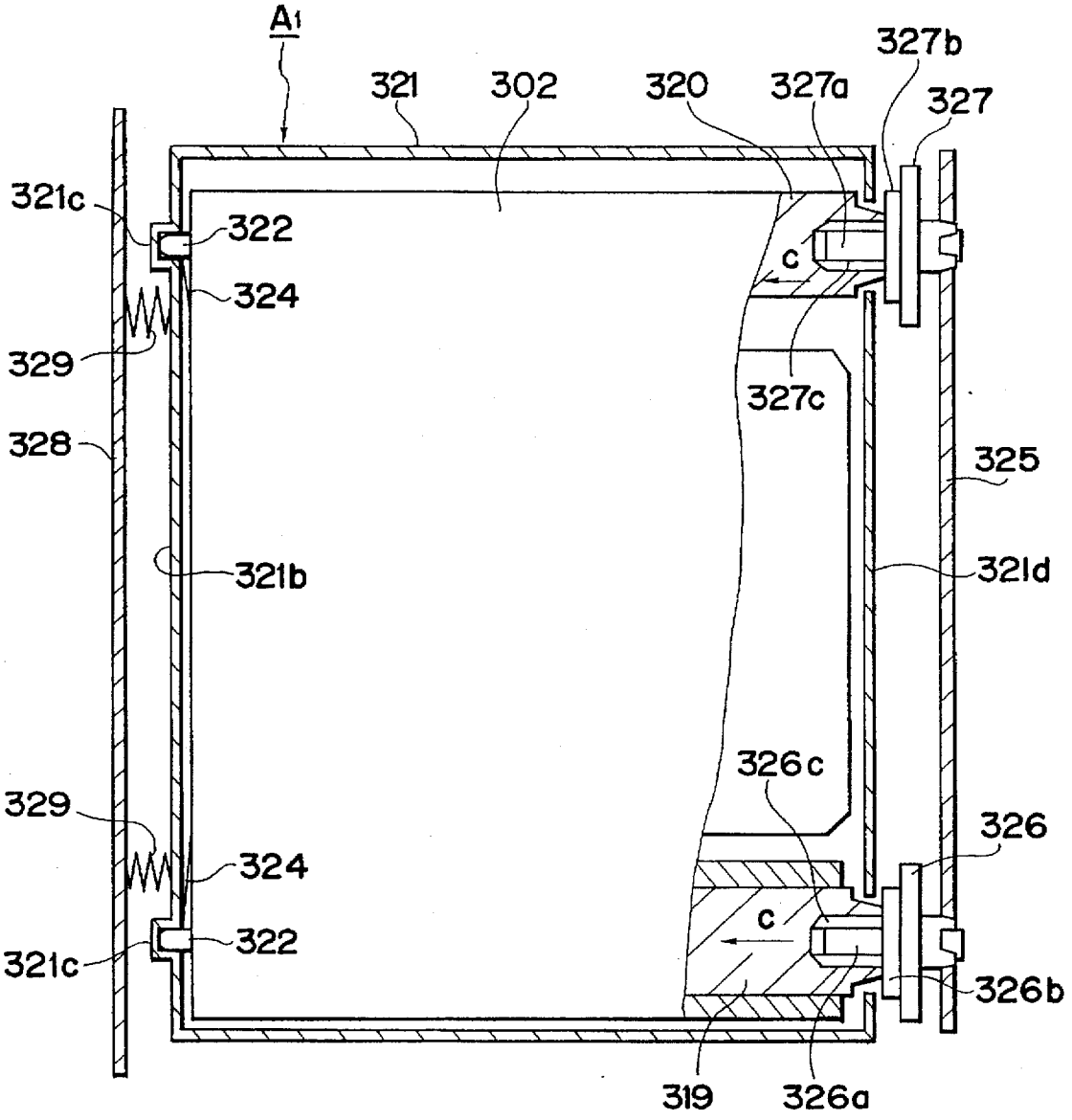
FIG. 13 is a view schematically showing the structure of the cassette shown in FIG. 10 in a state where the cassette is mounted in a cassette mounting portion.

For the cassette installation unit of the recording apparatus B, reel bases 326 and 327 are rotatively mounted on the chassis 325 as shown in FIG. 13. The aforesaid reel bases 326 and 327 comprise shaft portions 326*a* and 327*a* which are inserted into the small-diameter hollow cylinder portions 323 of the reels 319 and 320, and contacting portions 326*b* and 27*b* with which the leading ends of the aforesaid cylinder portions 323 are in contact, and on the aforesaid shaft portions 326*a* and 327*a*, nails 326*c* and 327*c* are formed in the radial direction to couple with the nails 323*b* of the cylinder portions 323.

One of the reel bases 326 is coupled to the supply reel 319 while the other reel base 327, to the winding reel 320. Then, the structure is arranged to provide the rotational force for the aforesaid reel base 327 through a driving power transmission mechanism (not shown) to allow the winding reel 320 to wind the ink sheet 302 for recording. On the other hand, the reel base 326 is structured so that a predetermined load is applied thereto when rotated to given a predetermined tension to the ink sheet 302 to be drawn from the supply reel 319.

Also, on the side wall 321*b* of the cassette 321, there is provided a pressure plate 328 which can be opened or closed. On this pressure plate 328, spring members 329 are provided. The biasing force of the spring members 329 is set to be stronger than that of the flat springs 324 provided for the cassette A1, and the structure is arranged so that when the pressure plate 328 is closed, the spring members 329 are caused to press the side wall 321*b* of the cassette A1 in the vicinities where the flat springs 324 are provided therefor.

Consequently, when the shaft portions 326*a* and 327*a* of the reel bases 326 and 327 are inserted into the small-diameter hollow cylinder portions 323 of the aforesaid cassette A1 and the pressure plate 328 is closed, the contacting portions 326*b* and 327*b* are caused to be in contact with the leading ends of the aforesaid cylinder portions 323 by the biasing force of the spring portions 329 and at the same time, compress the reels 319 and 320 in the direction indicated by arrow c in FIG. 13. Thus, the reels 319 and 320 slide in the direction indicated by arrow c to allow the taper portions 323 to leave the holes 321*e* of the case 321 with which the taper portions have been in contact. Hence, the reels 319 and 320 are in a state of free rotation. In this respect, the structure is arranged so as to cause the pivots 322 to butt the bottom of the concavities 321*c* thus determining the position of the reels in the longitudinal direction.

Subsequent to the cassette A1 having been mounted in the recording apparatus B in the manner as described above, the platen roller 303*b* is driven to convey the recording sheet 301 and ink sheet 302 while the recording head 303*a* is driven to cause the ink sheet 302 to be selectively heated, thus performing the recording.

In the cassette A1 structured as above, when the cassette A1 is removed from the cassette installation unit, the taper portions 323*a* are automatically in contact with the holes 321*a* of the case 321 by the biasing force of the flat springs 324, and the rotation of the reels 319 and 320 is regulated to prevent the slacking of the ink sheet 302.

Figure 14:
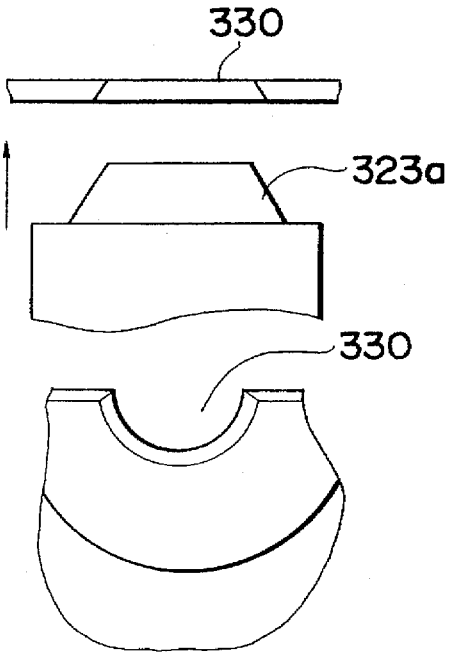
FIG. 14 is a view schematically showing a third embodiment of the cassette according to the present invention.

In the aforesaid embodiment, there is shown an example of the holes 321*e* of the case being formed on a plane to be in contact with the taper portions 323*a* of the small-diameter hollow cylindrical portions 323. However, as shown in FIG. 14 as a third embodiment, it may be possible to provide the holes 330 of the case in the same direction in which the taper portions 323*a* are formed, and to form them with the tapers having the same slanting angles. With such arrangement, the contacting faces with the taper portions 323*a* become greater, and the rotation of the reels 319 and 320 can be regulated more assuredly.

Figure 15:
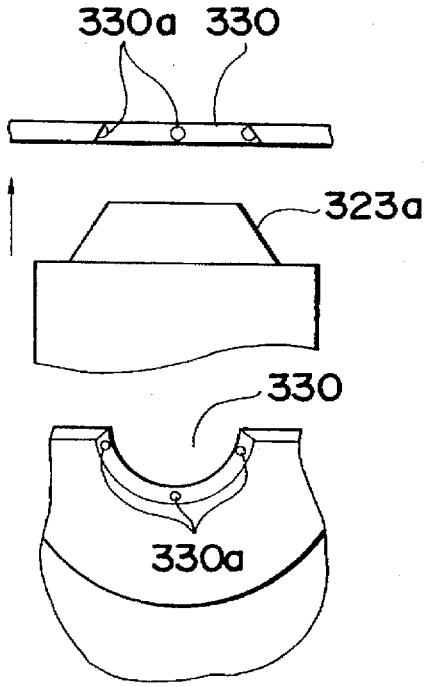
FIG. 15 is a view schematically showing a fourth embodiment of the cassette according to the present invention.

Also, it may be possible to provide projections 330*a* on the aforesaid tapering holes 330 as shown in FIG. 15 as a fourth embodiment to regulate the longitudinal direction and rotational direction when coupled with the reels 319 and 320. These projections can be provided on the taper portions 323*a* of the reels 319 and 320 as a matter of course.

Further, in the aforesaid second embodiment, the pressurized contact between the taper portions 323*a* and the holes 321*e* of the case is released by compressing the cassette A1 from the side plate 321*b* side of the case 321 by the spring members 329 mounted on the pressure plate 328. However, it should be possible to release the pressurized contact between the taper portions 323*a* and the holes 321*e* of the case by compressing the reels 319 and 320 from the reel base 326 side with a force which is greater than the biasing force of the spring 324 without the use of the spring members 329.

Also, a cassette for ink sheet is exemplified as the aforesaid cassette A1 in which the ink sheet 302 is accommodated, but its strip member is not necessarily limited to the aforesaid ink sheet 302. For example, it may be possible to use the cassette A1 for a cassette in which the magnetic tape for a video tape recorder is accommodated.

According to the present invention set forth above, the rotation of the first winding member and second winding member is regulated by forming the taper portions each at one end of the first and second winding members and pressing them against the case. Therefore, it is possible to make the structure simple to reliably prevent the winding members from running idle as well as to prevent the slacking of the strip member assuredly.

Subsequently, as a fifth embodiment of the cassette according to the present invention, the structure of a cassette A2 mountable in the aforesaid recording system B will be described specifically.

Figure 16:
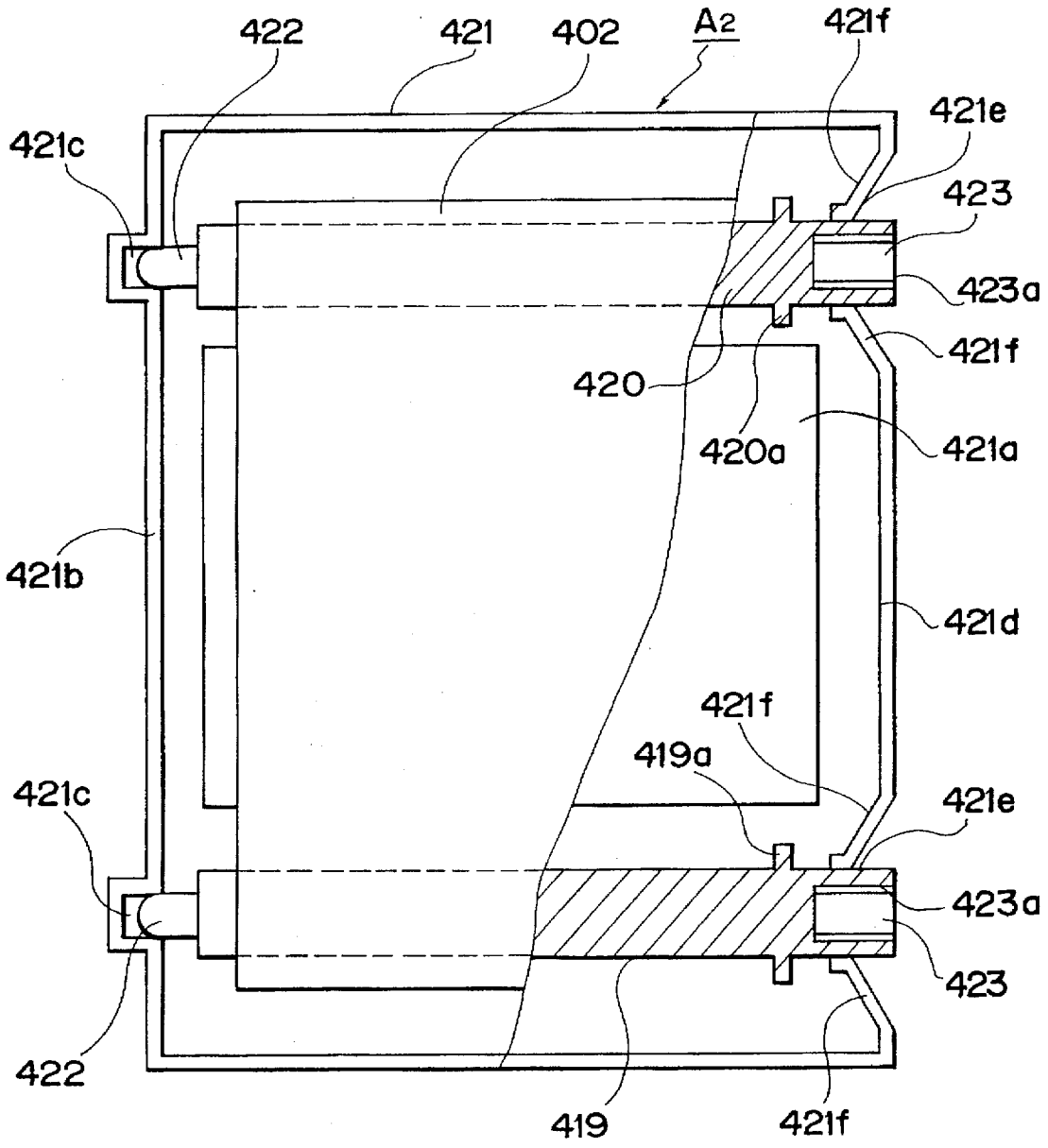
FIG. 16 is a view schematically showing a fifth embodiment of the cassette according to the present invention.

In FIG. 16, one side of a strip type ink sheet 402 is wound around a supply reel 419 which is a first winding member, and the other side thereof is wound around a winding reel 420 which is a second winding member. The aforesaid supply reel 419 and winding reel 420 are housed in a case 421.

Figure 17:
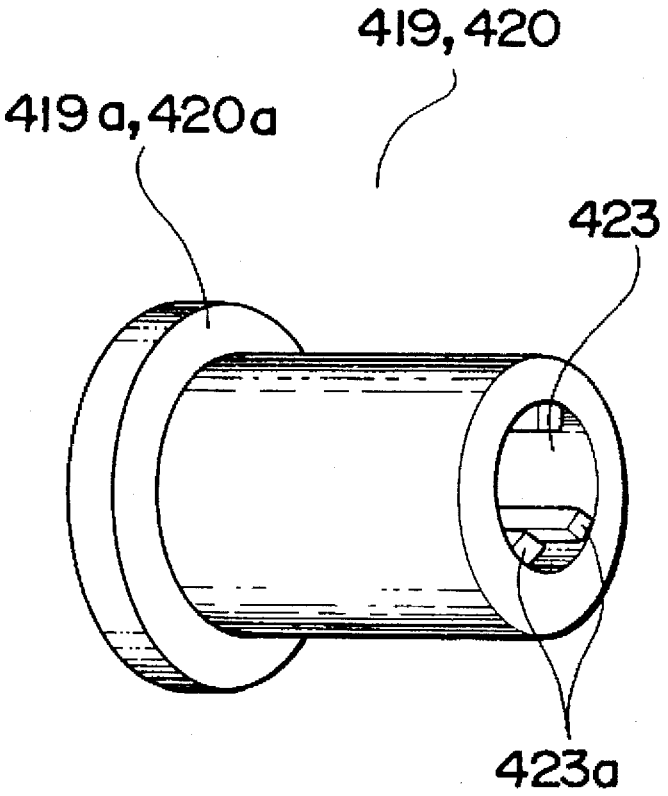
FIG. 17 is a view illustrating a hollow cylindrical portion of a small diameter.

At one end of each of the aforesaid reels 419 and 420, there is formed a pivot 422 in the longitudinal direction and at the other end thereof, a small-diameter hollow cylindrical portion 423, respectively. On the inner periphery of the aforesaid cylindrical portion 423, coupling nails 423*a* are formed as shown in FIG. 17. These coupling nails 423*a* are structured to couple with the reel base which will be described later.

The case 421 to house the aforesaid reels 419 and 420 is provided with a window 421*a* for recording in the center thereof as shown in FIG. 16 to allow the ink sheet 402 to be exposed, and on the side wall 421*b* at one side, there are formed concavities 421*c* which support the pivots 422 of the reels 419 and 420 rotatively. These concavities 421*c* are formed with the depth to allow the reels 419 and 420 to be slightly slidable in the longitudinal direction.

Figure 18:
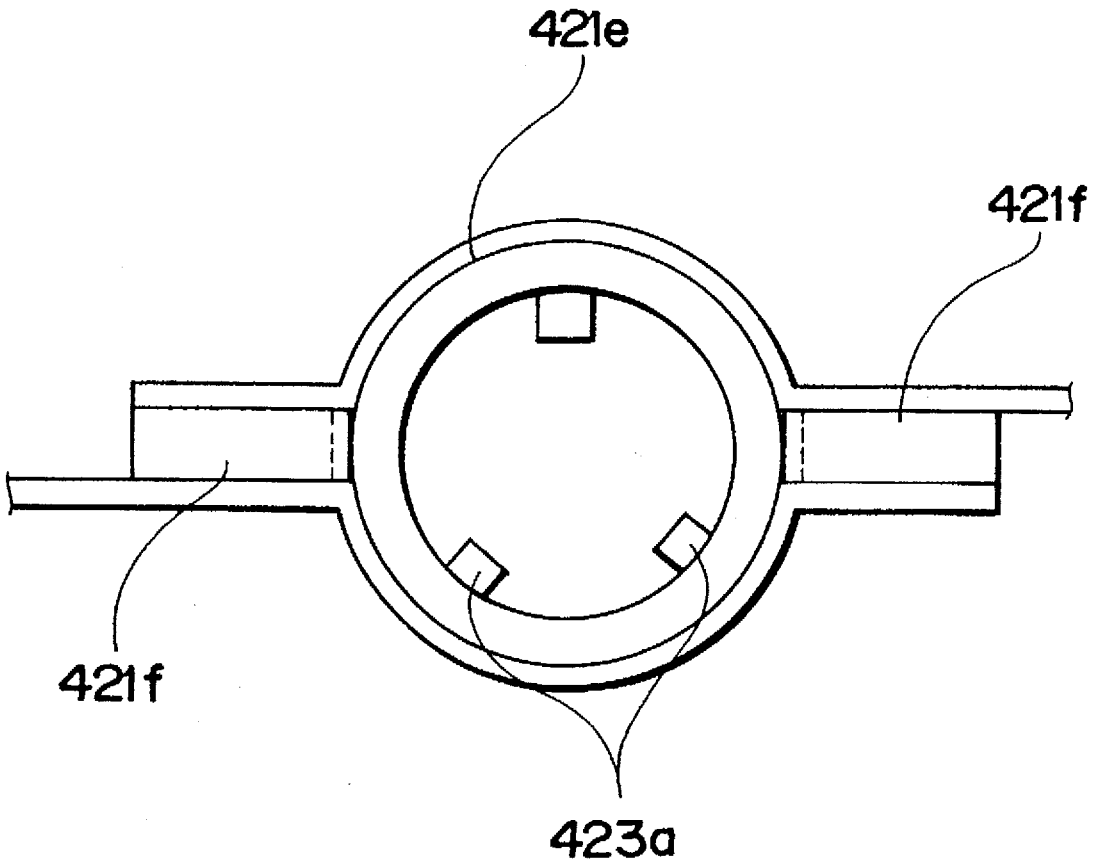
FIG. 18 is a view illustrating the fitting hole of a case.

Also, on the side wall 421*d* of the other side of the case 421, holes 421*e* are formed as shown in FIG. 16 and FIG. 18 to allow the small-diameter hollow cylindrical portions 423 of the reels 419 and 420 to be rotatively inserted. Then, at the predetermined positions of the aforesaid reels 419 and 420, flanges 419*a* and 420*a* are formed in such a structure that even when the reels 419 and 420 slide in the longitudinal direction, the pivots 422 are not allowed to fall off from the concavities 421*c* of the case.

In the opening portions 421*e* of the case 421, resilient biasing members 421*f*, which are in contact with the outer peripheries of the supply reel 419 and winding reel 420, are provided. These biasing members 421*f* are configured as shown in FIG. 18 to sandwich the outer peripheries of the reels 419 and 420 from the two directions. By this compression the rotation of the reels 419 and 420 is regulated because the friction load thus generated is applied to the rotation thereof. Therefore, when the cassette A1 is removed from the recording apparatus B, the idle rotation of the reels 419 and 420 is restricted thereby to prevent the slacking of the ink sheet 402.

Subsequently, the description will be made of the case where the aforesaid cassette A2 is mounted in the recording apparatus B.

Figure 19:
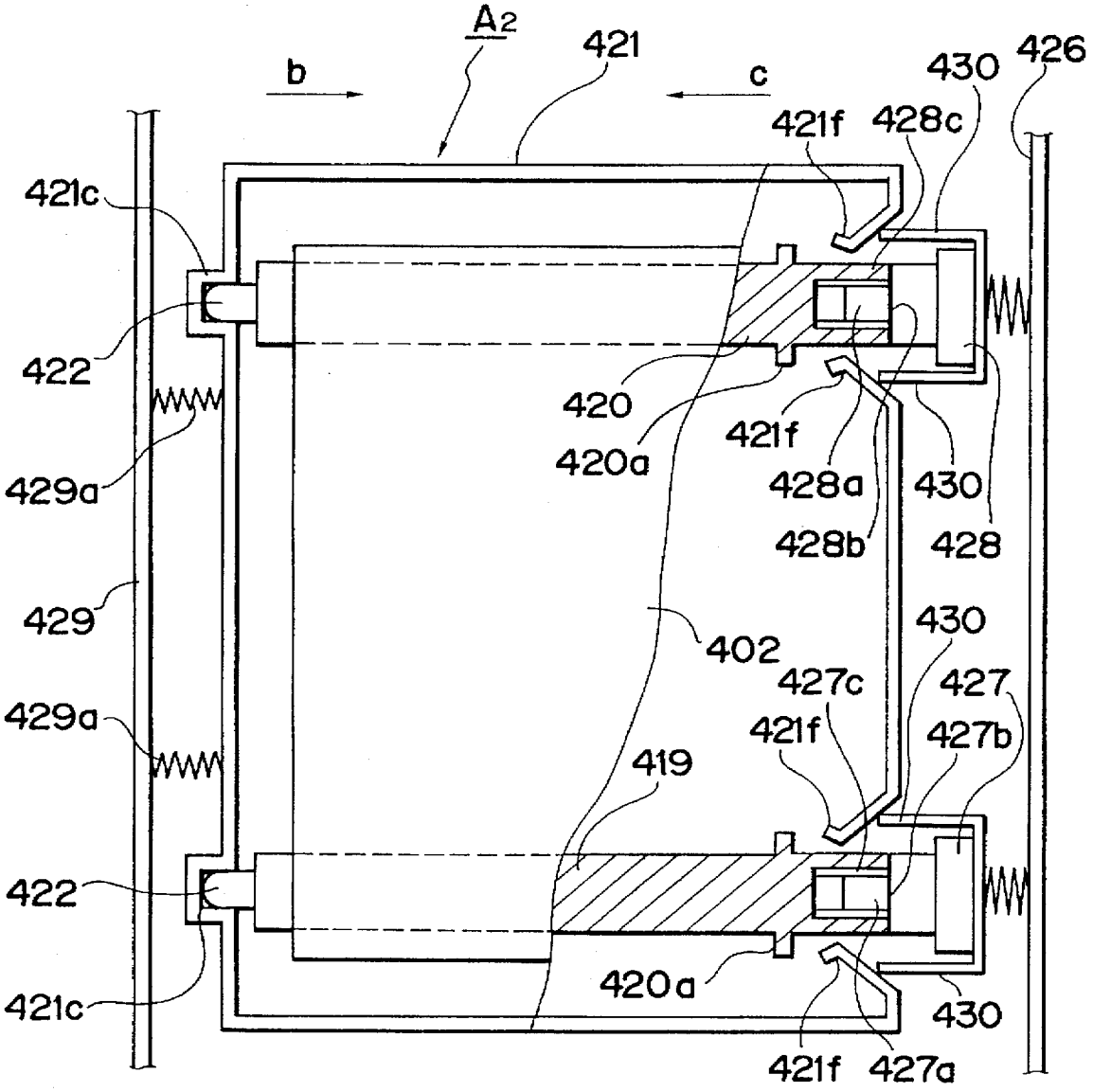
FIG. 19 is a view schematically showing the structure of the cassette shown in FIG. 16 in a state where the cassette is mounted in a cassette mounting portion.

For the cassette installation unit of the recording apparatus B, reel bases 427 and 428 are rotatively mounted on the chassis 426 as shown in FIG. 19. The aforesaid reel bases 427 and 428 comprise the shaft portions 427*a* and 428*a* which are inserted into the small-diameter hollow cylinder portions 423 of the reels 419 and 420, and contacting portions with which the leading ends of the aforesaid cylinder portions 423 are in contact, and on the aforesaid shaft portions 427*a* and 428*a*, nails 427*c* and 428*c* are formed in the radial direction to couple with the nails 423*b* of the cylinder portions 423.

Also, in the mind body of the recording apparatus, there is provided a cover 429 which can be opened or closed. On the inner side of this cover 429, thrust springs 429*a* are provided. By the biasing force of the springs 429*a*, the cassette A2 is biased in the direction indicated by arrow b in FIG. 19 when the cassette A2 is mounted in the recording system B and the aforesaid cover 429 are closed. Meanwhile, bias releasing projections 430 such as shown in FIG. 19 are installed on the reel bases 427 and 428.

Consequently, when the shaft portions 427*a* and 428*a* of the reel bases 427 and 428 are inserted into the small-diameter hollow cylinder portions 423 of the aforesaid cassette A2 and the cover 429 is closed, the contacting portions 427*b* and 428*b* are caused to be in contact with the leading ends of the aforesaid cylinder portions 423 by the biasing force of the bias springs 429*a* and at the same time, compress the reels 419 and 420 in the direction indicated by arrow c in FIG. 19. Then, at this juncture, the pivots 422 are caused to butt the bottom of the concavities 421*c* thus defining the positions of reels in the longitudinal direction. Also, when the cassette is mounted, the aforesaid bias releasing projections 430 compress the biasing member 421*f* of the cassette case 421 in the direction indicated by arrow c. By this compression, the biasing members 421*f* are resiliently deformed to cause the pressurized state against the outer peripheries of the reels 419 and 420 to be released.

The reel base 428 coupled to aforesaid winding reel 420 can be driven to rotate through a power transmission mechanism (not shown) to wind the ink sheet 402 around the winding reel 420 for recording. On the other hand, the reel base 427 coupled to the supply reel 419 is structured to be provided with a predetermined load when rotated so as to give a predetermined amount of tension to the ink sheet 402 to be drawn from the supply reel 419.

Now, subsequent to the cassette A2 having been mounted in the recording apparatus B in the manner as described above, the platen roller 303*b* is driven to convey the recording sheet 301 and ink sheet 302 while the recording head 303*a* is driven to cause the ink sheet 302 to be selectively heated, thus performing the recording.

In the cassette A2 structured as above, when the cassette A2 is removed from the cassette installation unit, the biasing members 421*f* are again in contact with the outer peripheries of the reels 419 and 420 to regulate the rotation of the reels 419 and 420, hence preventing the slacking the ink sheet 402.

Figure 20:
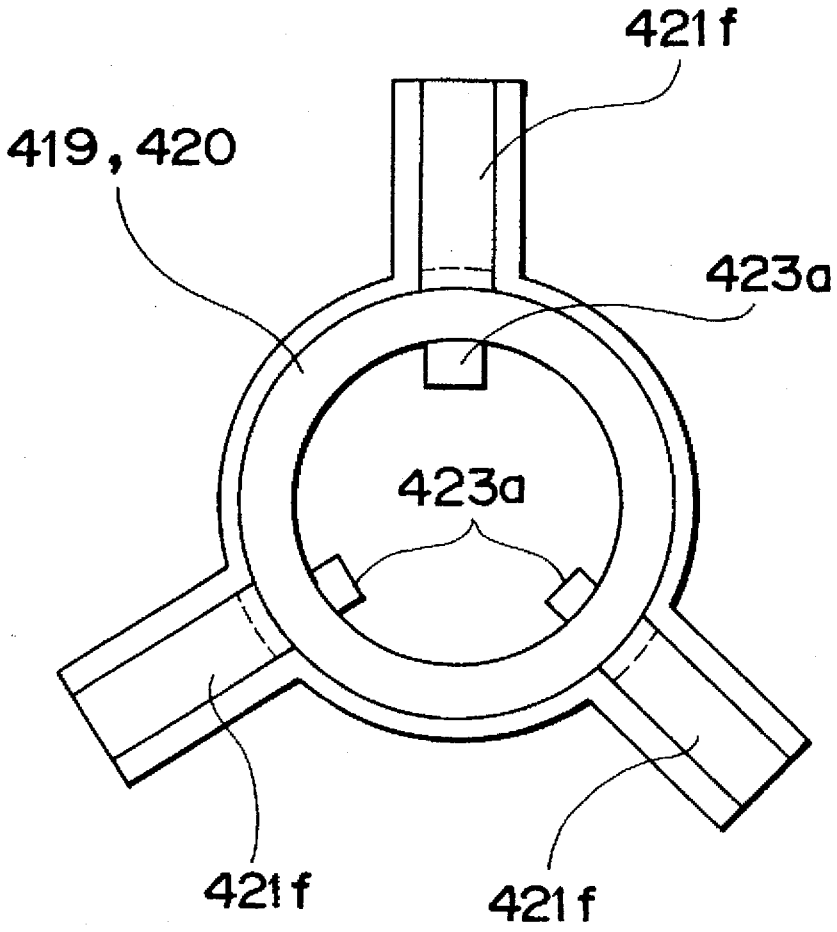
FIG. 20 is a view schematically showing a sixth embodiment of the cassette according to the present invention.

In the aforesaid fifth embodiment, the biasing members 421*f* are in contact with the reels 419 and 420 under pressure from the two directions (refer to FIG. 18). However, as shown in FIG. 20 as a sixth embodiment, it may be possible to arrange the biasing members 421*f* to be in contact with the reels 419 and 420 under pressure from three directions (or three directions or more).

In this respect, a cassette for an ink sheet is examplified as the cassette A2 in which the ink sheet 402 is accommodated, but its strip member is not necessarily limited to be the aforesaid ink sheet 402. For example, it may be possible to use the cassette A2 for a cassette in which the magnetic tape for a video tape recorder is accommodated.

According to the present invention as set forth above, it is possible to reliably prevent the winding members from running idle as well as to prevent the slacking of the strip member assuredly because the structure is arranged so that the first and second winding members are partially in contact with the case under pressure.

Also, with the present invention, it is possible to provide a simple and compact cassette by reducing the numbers of parts even for a cassette such that the distance between the shafts of the reels are comparatively long and the opening for its moving member is arranged between them.

Subsequently, the description will be made of a seventh embodiment of the cassette according to the present invention and a recording apparatus using the aforesaid cassette.

At first, in reference to FIG. 21, the structure of a cassette A3 will be described.

Figure 21:
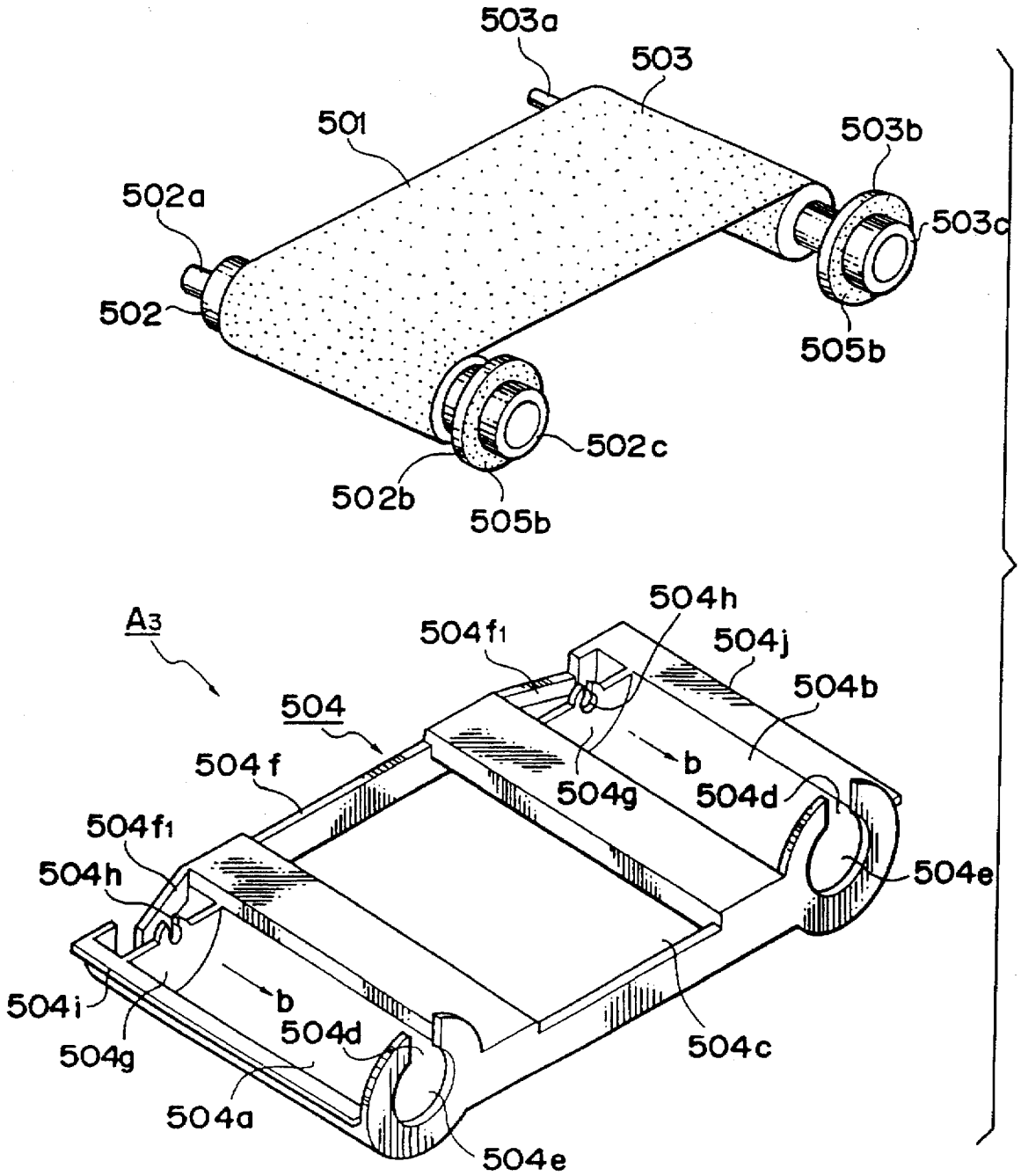
FIG. 21 is a view schematically showing a seventh embodiment of the cassette according to the present invention.

In FIG. 21, a reference numeral 501 designates an ink sheet produced by coating a thermal transfer ink (thermofusible, thermally sublimate, and the like) on a strip type base film, and this in sheet 501 is wound around a supply reel 502 and a winding reel 503. At the ends of the aforesaid supply reel 502 and winding reel 503 on one side each in the axial direction, pivot portions 502*a* and 503*a* are formed in the same fashion, and at the other ends thereof, flange portions 502*b* and 503*b* are formed. Further, from these flange portions 502*b* and 503*b*, hollow cylindrical portions 502*c* and 503*c* are projectingly formed.

Then, a reference numeral 504 designates a plastic frame, and at both ends thereof, reel housing concavities 504*a* and 504*b* are formed for housing the aforesaid supply reel 502 and winding reel 503. In the central portion of the frame, a window 504*c* for recording is provided. At the upper ends of the side walls of the aforesaid reel housing portions 504*a* and 504*b* on one side, cutaway portions 504*d* are formed in the width narrower than the diameter of the hollow cylindrical portions 502*c* and 503*c* of the aforesaid reels 502 and 503. In continuity with these cutaway portions 504*d*, reel supporting portions 504*e* are opened for rotatively supporting the hollow cylindrical portions 502*c* and 503*c*.

Also, in the vicinity of the side walls 504*f* of the aforesaid reel housing concavities 504*a* and 504*b* on the other side, standing walls 504*g* are formed, and on these standing walls 504*g*, the bearing portions 504*h* are provided to receive the pivot portions 502*a* and 503*a* of the reels 502 and 503.

In this respect, the distance between the aforesaid side walls 504*f* and standing walls 504*g* is made slightly shorter than the length of the pivot portions 502*a* and 503*a* of the aforesaid reels 502 and 503, and these side walls 504*f* and reel supporting portions 504*e* are structured to be resiliently deformative.

In assembling the aforesaid cassette A3, the pivot portions 502*a* and 503*a* of the supply reel 502 and winding reel 503 around which the ink sheet 501 are wound are inserted into the bearing portions 504*h* of the frame 504. Then, the hollow cylindrical portions 502*c* and 503*c* are inserted into the reel supporting portions 504*e* forcibly through the cutaway portions 504*d* of the frame 504. At the time of this forcible insertion, the reef supporting portions 504*e* are resiliently deformed in the direction indicated by arrow a in FIG. 22, and returned to the original state after the insertion.

Thus, the reels 502 and 503 are mounted in the frame 504 rotatively and also in a state that the reels do not fall off. At this juncture, the ends of the aforesaid pivot portions 502*a* and 503*a* are in contact with the resilient biasing portions $504f_1$ which partially constitute the side wall 504*f*, and are biased in the axial direction (in the direction indicated by arrow b in FIG. 21) simultaneously.

Figure 23:
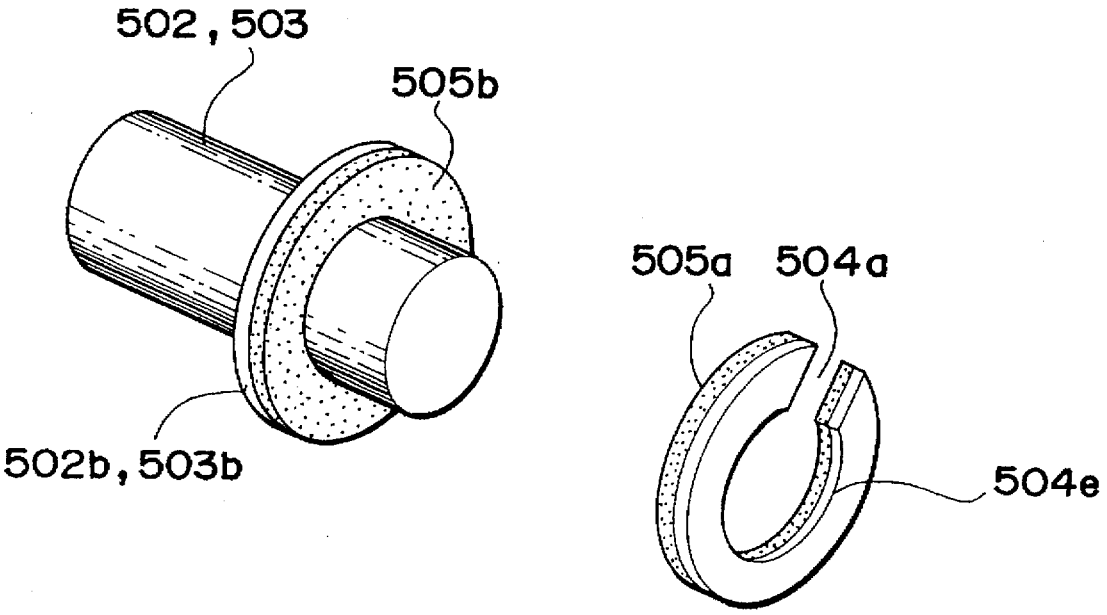
FIG. 23 is a view illustrating the structure of a reel rotation regulating means.

In the cassette A3 according to the the present embodiment in this respect, a rotation regulating means is configured by providing the inner sides of the reel supporting portions 504*e* and the outer sides of the flange portions 502*b* and 503*b* of the reels 502 and 503 with members 505*a* and 505*b* having a high friction coefficient such as felt or rubber, respectively, as shown in FIG. 23. By causing these high friction coefficient members 505*a* and 505*b* to be in contact under pressure with each other, the supply reel 502 and winding reel 503 are prevented from running idle at the time of storage, transportation, and the like.

Since the aforesaid cassette A3 comprises only the supply reel 502 and winding reel 503 around which the ink sheet 501 is wound, the numbers of parts are small, and the assembly operation of the cassette A3 is extremely simple because the cassette can be assembled by inserting the supply reel 502 and winding reel 503 forcibly into the frame 504.

Now, the description will be made of a recording apparatus using the aforesaid cassette A3.

Figure 24:
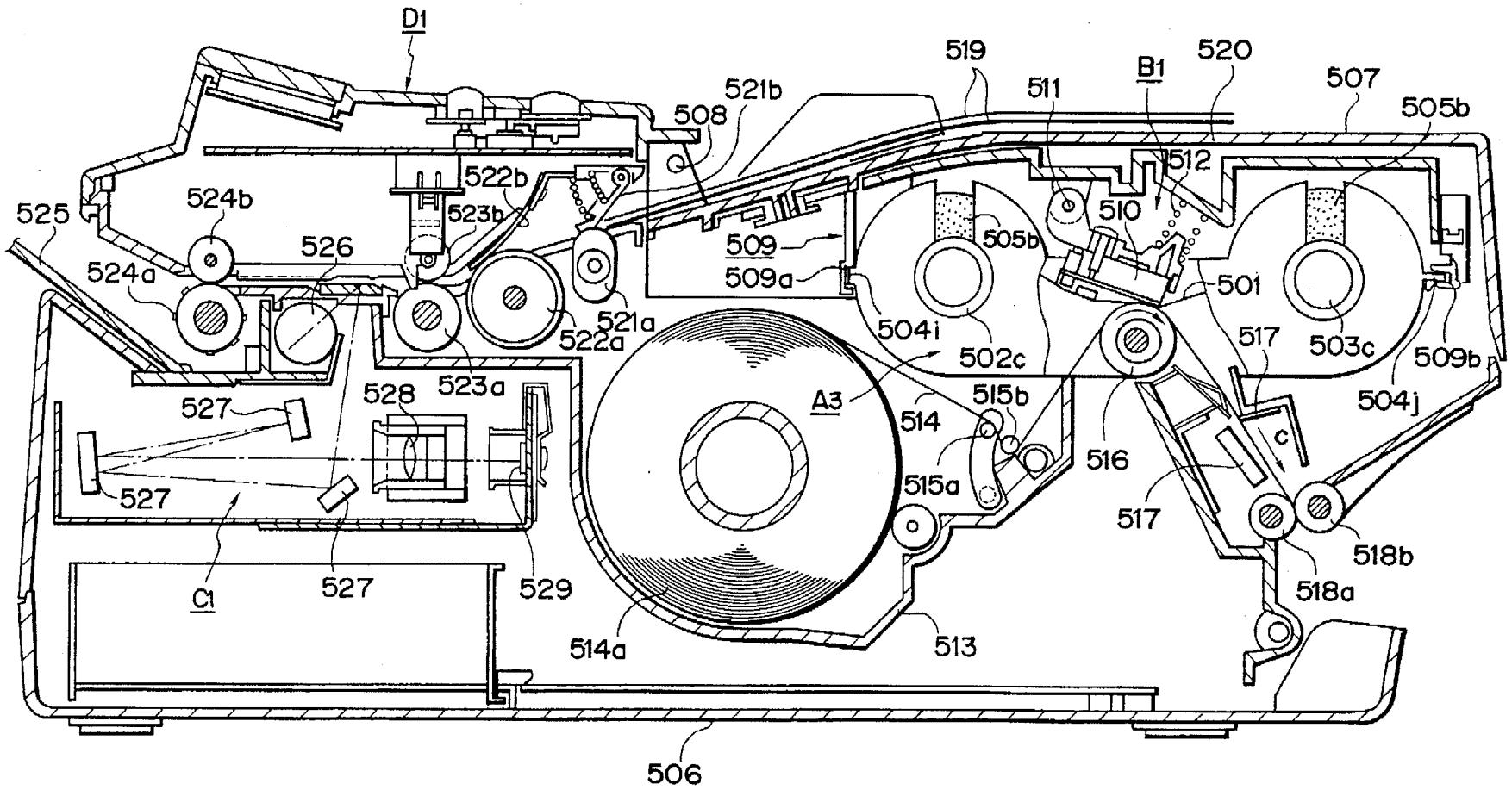
FIG. 24 is a view schematically showing the structure of a facsimile apparatus as a recording apparatus using the cassette shown in FIG. 21.

FIG. 24 is a view showing a recording apparatus B1 using the aforesaid cassette A3 as the recording system for a facsimile apparatus. This facsimile apparatus comprises the recording system B1 as its recording apparatus, a reading system C1 for reading the image written on an original, and an operation panel D1 as shown in FIG. 24.

The cover 507 of the recording system B1 is structured to be opened or closed with the shaft 508 as its center with respect to the main body of the facsimile apparatus 506, and in the aforesaid cover 507 side, a cassette installation unit 509 is provided. This cassette installation unit 509 serves to mount the aforesaid cassette A3 therein, and is configured in such a manner that one of the hooking portion 504*i* of the hooking portions 504*i* and 504*j* projectingly provided on the frame 504 of the cassette A3 is hooked into one of the hooking concavities 509*a* constituting the installation unit 509 on the cover 507 while the other hooking portion 504*j* is hooked, into the other hooking concavity 509*b* for mounting the cassette A3 in the cover 507.

Also, in the cover 507, a recording head 510 is installed which constitutes a recording means. This recording head 510 is a so-called thermal head, and on the surface of the head substrate, the exothermic elements, which generate heat when energized, are arranged in line. The recording head thus arranged is rotatively installed on the cover 507 with a shaft 511 as its center. Then, the aforesaid exothermic elements are compressed downward by a compression spring 512 so as to be in contact with the base film side of the ink sheet 501 through the recording window 504*c* of the cassette A3.

On the other hand, in the main body 506 of the apparatus, a roll holder 513 is provided. Its structure is arranged so that a sheet roll 514*a* formed by winding a strip type recording sheet 514 around this holder 513 is accommodated therein. This recording sheet 514 is drawn to a platen roller 516 through guide shafts 515*a* and 515*b* in a state where the cover 507 is opened, and when the cover 507 is closed, the recording sheet is overrupped with the ink sheet 501 in the cassette A3. At this juncture, the reel shafts (not shown) are fitted into the hollow cylindrical portions 502*c* and 503*c* of the supply reel 502 and winding reel 503 of the aforesaid cassette A3 to bias the aforesaid reels 502 and 503 in the opposite direction indicated by arrow b in FIG. 21, so that the high frictional member 505*a* of the flange portions 502*b* and 503*b* and the high fricional member 505*b* of the hollow cylindrical portions 502*c* and 503*c* are set apart from each other. Hence, the aforesaid reels 502 and 503 are set in a state of free rotation.

Figure 22:
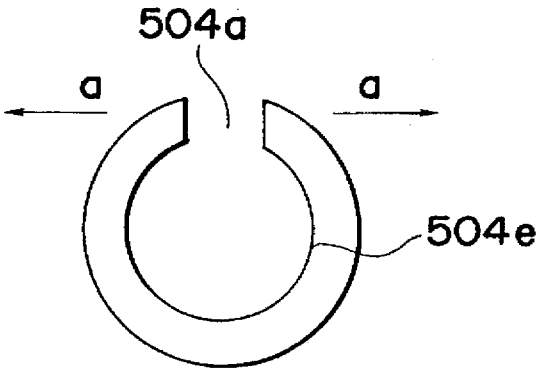
FIG. 22 is a view illustrating a reel holding portion.

The aforesaid platen roller 516 serves as a conveying means for conveying the recording sheet 514, and when the recording is performed, the aforesaid platen roller 516 and the winding reel 503 are driven by a motor (not shown) to convey the recording sheet 514 and ink sheet 501 in the directions indicated by arrows c and d in FIG. 22 respectively. Then, the structure is arranged so that in synchronism with the conveyance of the aforesaid recording sheet 514 and ink sheet 501, the recording head 510 is caused to generate heat in response to the image signals to fuse ink of the ink sheet 501 to be transferred onto the recording sheet 514 for the formation of the image thereon.

The recording sheet 514 on which a specific image has been formed such as this is further conveyed in the direction indicated by arrow c and is exhausted to the outside of the apparatus by a pair of exhausting rollers 518*a* and 518*b* subsequent to having been cut by a cutter 517.

Also, the reading system C1 irradiates the original 519 by light and converts the reflected rays of light into the electric signals to transmit these signals to another machine or to the recording system B1 of its own.

In other words, plural originals 519 are stacked on an original stacker 520 provided on the cover 507, and these originals 519 are preliminarily conveyed by a preliminary carrier roller 521*a* and compression blade 521*b* and at the same time, are separated one by one to be carried by a separation roller 522*a* and pressure blade 522*b*. Then, the structure is arranged to convey and exhaust the original 519 to an exhaust tray 525 by a pair of carrier rollers 523*a* and 523*b* and exhausting rollers 524*a* and 524*b*. While the aforesaid original 519 is being conveyed, the surface of the original is irradiated by light from a light source 526, and the reflected rays of light are allowed to reach a photoelectric converting element 529 such as a CCD through a mirror 527 and a lens 528. Then, the structure is arranged to transmit the image signals to the recording system of its own in the case of copying mode, or to the recording system of another machine in the case of transmission mode.

In this respect, a recording system of a facsimile apparatus is examplified as the recording apparatus according to the present embodiment. However, the recording apparatus is not limited thereto as a matter of course, and for example, the apparatus may be applicable to a printer.

According to the present invention set forth above, the cassette is structured by the reels around which the ink sheet is wound, and the frame while the reel supporting portions and biasing portions are provided on the frame. As a result, bias springs and the like which are conventionally needed are not required, thus making it possible to reduce the numbers of parts as well as to make the assembly operation easy to implement the reduction of manufacturing cost.

Also, by providing a reel rotation regulating means with the aforesaid cassette, it is possible to prevent the reels from running idle.

What is claimed is:

1. A recording apparatus for recording by transferring ink from an ink sheet, said apparatus comprising:

a recording head for effecting heat to ink of the ink sheet;

a mounting portion;

an ink sheet cassette mountable on said mounting portion, said ink sheet cassette having first and second reel members for winding an ink sheet, with said first reel member winding one end of the ink sheet and said second reel member winding a second end of the ink sheet;

a housing for rotatably containing said first and second reel members such that said reel members are displaceable in an axial direction;

a limit portion for engaging an outer periphery of said reel members at a contact point and pressing said reel members in a direction toward the axial direction, said limit portion preventing the rotation of said reel members at substantially the point of contact on said reel members regardless of the rotational position of said reel members; and press means for applying a first pressing force to said reel members in the axial direction to contact said reel members against said limit portion, wherein when said housing is mounted on said recording apparatus said reel members are displaced by a second pressing force which is greater than the first pressing force by said press means and in an opposite axial direction so that said reel members are released from contact with said limit portion and rotatable, and when said housing is removed from said recording apparatus said reel members are displaced by the first pressing force by said press means so that said reel members are in contact with said limit portion and prevented from rotating; and biasing means provided on said mounting portion to apply to said housing of said ink sheet cassette a press force which exceeds the press force by said press means in an opposite direction.

2. A recording apparatus for recording by transferring ink from an ink sheet, said apparatus comprising:

a recording head for effecting heat to ink of the ink sheet;

a mounting portion;

an ink sheet cassette mountable on said mounting portion, said ink sheet cassette having first and second reel members for winding an ink sheet, with said first reel member winding one end of the ink sheet and said second reel member winding a second end of the ink sheet;

a housing for rotatably containing said first and second reel members such that said reel members are displaceable in an axial direction;

a limit portion for engaging an outer periphery of said reel members at a contact point and pressing said reel members in a direction toward the axial direction, said limit portion preventing the rotation of said reel members at substantially the point of contact on said reel members regardless of the rotational position of said reel members; and press means for applying a first pressing force to said reel members in the axial direction to contact said reel members against said limit portion, wherein said reel members are displaceable by a second pressing force which is greater than the first pressing force in an opposite axial direction so that said reel members are released from contact with said limit portion and rotatable; and biasing means provided on said mounting portion to apply to said housing of said ink sheet cassette the second pressing force which exceeds the first pressing force applied by said press means in an opposite axial direction.

3. An ink sheet cassette mountable on a recording apparatus for recording by transferring ink from an ink sheet, said cassette comprising:

first and second reel members for winding an ink sheet, with said first reel member winding one end of the ink sheet and said second reel member winding a second end of the ink sheet;

a housing for rotatably containing said first and second reel members such that said reel members are displaceable in an axial direction;

a limit portion for engaging an outer periphery of said reel members at a contact point and pressing said reel members in a direction toward the axial direction, said limit portion preventing the rotation of said reel members at substantially the point of contact on said reel members regardless of the rotational position of said reel members; and press means for applying a first pressing force to said reel members in the axial direction to contact said reel members against said limit portion, wherein when said housing is mounted on the recording apparatus said reel members are displaced by a second pressing force that is greater than the first pressing force in an opposite axial direction so that said reel members are released from contact with said limit portion and rotatable, and when said housing is removed from the recording apparatus said reel members are displaced by the first pressing force by said press means so that said reel members contact said limit portion and are prevented from rotating.

4. An ink sheet cassette mountable on a recording apparatus for recording by transferring ink from an ink sheet, said cassette comprising:

first and second reel members for winding an ink sheet, with said first reel member winding one end of the ink sheet and said second reel member winding a second end of the ink sheet;

a housing for rotatably containing said first and second reel members such that said reel members are displaceable in an axial direction;

a limit portion for engaging an outer periphery of said reel members at a contact point and pressing said reel members in a direction toward the axial direction, said limit portion preventing the rotation of said reel members at substantially the point of contact on said reel members regardless of the rotational position of said reel members; and press means for applying a first pressing force to said reel members in the axial direction to contact said reel members against said limit portion, wherein said reel members are displaceable by a second pressing force greater than the first pressing force in an opposite axial direction so that said reel members are released from contact with said limit portion and are rotatable.

* * * * *

UNITED STATES PATENT AND TRADEMARK OFFICE

CERTIFICATE OF CORRECTION

PATENT NO. : 5,667,318

DATED : September 16, 1997

INVENTOR(S) : Tanno et al.

It is certified that error appears in the above-identified patent and that said Letters Patent is hereby corrected as shown below:

[57] ABSTRACT:

Line 2, "molted" should read --mounted--.

COLUMN 6:

Line 50, "overrupped" should read --overlapped--.

COLUMN 8:

Line 54, "given" should read --give--.

COLUMN 10:

Line 41, "given" should read --give--.

COLUMN 12:

Line 50, "mind body" should read --main body--.

UNITED STATES PATENT AND TRADEMARK OFFICE

CERTIFICATE OF CORRECTION

PATENT NO. : 5,667,318

DATED : September 16, 1997

INVENTOR(S) : Tanno et al.

It is certified that error appears in the above-identified patent and that said Letters Patent is hereby corrected as shown below:

COLUMN 15:

Line 35, "overrupped" should read --overlapped--.

Signed and Sealed this

Eighth Day of September, 1998

Bruce Lehman

*Attest:*

BRUCE LEHMAN

*Attesting Officer*

*Commissioner of Patents and Trademarks*